US006211795B1

(12) United States Patent
Izuta

(10) Patent No.: US 6,211,795 B1
(45) Date of Patent: Apr. 3, 2001

(54) RECEIVER HAVING CAPABILITY OF SELECTIVE STORAGE OF RECEIVED MESSAGE

(75) Inventor: Satoshi Izuta, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/049,207

(22) Filed: Mar. 27, 1998

(30) Foreign Application Priority Data

Mar. 28, 1997 (JP) ..... 9-078265

(51) Int. Cl.[7] ..... G08B 5/22
(52) U.S. Cl. ..... 340/825.44; 340/825.26
(58) Field of Search ..... 340/825.44, 825.27, 340/825.26

(56) References Cited

U.S. PATENT DOCUMENTS 4,962,377 * 10/1990 Wallace et al. ..... 340/825.44
5,075,684 * 12/1991 DeLuca et al. ..... 340/825.44
5,258,739 * 11/1993 DeLuca et al. ..... 340/825.44
5,627,525 * 5/1997 Kudoh et al. ..... 340/825.44
5,797,098 * 8/1998 Schroeder et al. ..... 455/464
5,936,548 * 8/1999 Takatsuka ..... 340/825.44

FOREIGN PATENT DOCUMENTS 7131840 5/1995 (JP) .

* cited by examiner

*Primary Examiner*—Michael Horabik
*Assistant Examiner*—M Shimizu

(57) ABSTRACT

A signal transmitted from an information service carrier is received b an antenna, and tuned and detected by an RF unit. The detected signal is demodulated and then supplied to a decoder unit. It is judged whether a distinction ID code coincides with the own ID code stored in an ID-ROM or not. If the codes coincide with each other, message information is obtained from a signal which is subsequently received, and an interrupt signal indicative of reception of an effective signal is outputted. In response to the interrupt signal, a control unit actives operation programs which are previously stored in a program memory. The received message information is temporarily stored in a temporary message storage buffer. A received message containing a keyword which is previously stored in a keyword storing unit is selected, and then stored in a received message storing unit.

9 Claims, 26 Drawing Sheets

FIG. 2

35a 41 42 43

| | KEYWORD | NOTIFYING METHOD |
|---|---|---|
| 1 | WALK | 1 |
| 2 | UEDA STATION | 3 |
| 3 | KOBAYASHI STATION | 0 |
| 4 | APARTMENT | 6 |
| 5 | SMALL-SIZED APARTMENT | 0 |
| 6 | DETACHED HOUSE | 0 |
| 7 | EOF | |
| | | |
| | | |

42a

42b

FIG. 3

36a

| MESSAGE |
|---|
| NEW-BUILT APARTMENT 3LDK, 7 MINUTES WALK FROM UEDA STATION OF YAMADA LINE, NEAR ELEMENTARY SCHOOL ... |

44

81

82 83 84

| CODE | NOTIFYING METHOD | DISPLAY CHARACTER STRING |
|---|---|---|
| 1 | HIGH ALARM SOUND | ALH |
| 2 | LOW ALARM SOUND | ALL |
| 3 | MELODY A | MLA |
| 4 | MELODY B | MLB |
| 5 | MELODY C | MLC |
| 6 | VIBRATOR | VIB |
| 0 | NOTHING | (NOT DISPLAYED) |

FIG. 27

15

[TRANSMITTED MESSAGE]
"NEW-BUILT APARTMENT 3LDK, 7 MINUTES WALK FROM UEDA STATION OF YAMADA LINE,
NEAR ELEMENTARY SCHOOL, FOR FURTHER INFORMATION CONTACT SHIMODA HOUSING"

RECEIVER HAVING CAPABILITY OF SELECTIVE STORAGE OF RECEIVED MESSAGE

BACKGROUND OF THE INVENTION

1. Field of the Invention

The present invention relates to a receiver which receives message information, or a so-called paging receiver (also called a pager).

2. Description of the Related Art

FIG. 26 is a block diagram showing the electrical configuration of a conventional paging receiver 1. A signal transmitted from an information service carrier by wireless transmission or the like is received by an antenna 4, and tuned and detected by an RF unit 5. The detected signal is demodulated and then supplied to a decoder unit 6.

In the decoder unit 6, a destination ID code is obtained from a pager format signal of, for example, the POCSAG system, and it is judged whether the ID code coincides with the own ID code stored in an ID-ROM 7 or not. If the codes coincide with each other, message information is obtained from a signal which is subsequently received. Furthermore, an interrupt signal indicative of reception of an effective signal is outputted.

In response to the interrupt signal, a control unit 2 activates operation programs which are previously stored in a program memory 3, such as those for processes of storing and displaying the received message. The received message information is stored in a received message storing unit 8, and displayed on an LCD (liquid crystal display) 10 which is driven by an LCD driver 9.

When execution of a process such as message deletion is instructed through a key input unit 11, the process such as deletion is conducted on the received message. A vibration generating unit 12 notifies the user of reception of a message by a vibration, and an alarm/melody sound generating unit 13 acoustically notifies the user of reception.

The control unit 2, the program memory 3, the decoder unit 6, the received message storing unit 8, the LCD driver 9, the key input unit 11, the vibration generating unit 12, and the alarm/melody sound generating unit 13 are electrically connected to each other via a bus line 14.

FIG. 27 shows a message 15 which is transmitted from an information service carrier and received by the paging receiver 1. FIGS. 28A to 28C show in stages display screens 16*a* to 16*c* in the case where the message 15 is displayed on the LCD 10. In the paging receiver 1, a data indicative of the reception date and time is stored together with the message 15 in the received message storing unit 8. Therefore, the reception date and time is displayed on the LCD 10 in addition to the message 15.

Since the display capacity of the LCD 10 is limited, the whole of a message is not always displayed. A message number 18, the message 15, and the reception date and time 19 are set to be total data to be displayed. A display virtual area 17 which includes these data is assumed. As shown in FIGS. 28A to 28C, in the actual display screens 16*a* to 16*c* which are smaller than the display virtual area 17, the data are displayed in a split manner.

The display screens 16*a* to 16*c* are switched over by operating a display message downward button 20*a* and a display message upward button 20*b*.

Another example of a pager of the prior art is disclosed in Japanese Unexamined Patent publication JP-A 7-131840 (1995). The pager is provided with a ROM for classifying received messages in accordance with the contents, so that the stored received messages can be quickly searched. Specifically, messages are classified by the kind of the end of a sentence. For example, a message ended by "KUDASAI (please)" is stored as "Instruction" category, that ended by "SHIMASU (will do)" is stored as "Memo" category, and that ended by "TAI? (would you?)" is stored as "Question" category.

In accordance with increasing requests of the user for the variety and amount of information, the paging service is advancing so as to provide a wide variety of and a large amount of information. In a paging receiver, the capacity of a memory for storing received messages is made larger. It is difficult to select a necessary message from such a large amount of received messages.

In the pager disclosed in Japanese Unexamined Patent Publication JP-A 7-131840 (1995), all received messages are stored, and it is difficult to select a necessary message as described above, thereby producing problems in that the operability is lowered, and the memory capacity is wastefully used. Moreover, the pager has a further problem in that necessary messages cannot be stored in an increased number.

Furthermore, messages are classified only by the kind of the end of a sentence. In order to correctly classify a message, the sender of a message must prepare the message in consideration of this classification system. If such consideration is not sufficiently performed, there arises a disadvantage that the message cannot be classified. Since a ROM is used for classification, the user cannot freely change the classification category.

SUMMARY OF THE INVENTION

It is an object of the invention to provide a receiver capable of selectively storing a desired message among all received messages. It is another object of the invention to provide a receiver capable of storing among all received messages, a desired message as distinguished from the other messages.

The invention provides a receiver which receives a message transmitted from a terminal device and stores the received message in message storing means, comprising:

keyword setting means for setting a predetermined keyword;

keyword storing means for storing the preset keyword;

judging means for, when a message is received, judging whether the received message contains the keyword stored in the keyword storing means or not; and controlling means for storing only a received message which is judged by the judging means to contain the keyword, in the message storing means.

According to the invention, among received messages, only a message containing the predetermined keyword is stored. Therefore, only necessary messages can be selectively stored, the operability is improved, and the wasteful use of the memory capacity is reduced. Furthermore, a larger number of necessary received messages can be stored. Since the keyword can be arbitrarily set by the user, the kind of a message to be stored can be freely selected.

The invention provides a receiver which receives a message transmitted from a terminal device and stores the received message in message storing means, the receiver comprising:

keyword setting means for setting a predetermined keyword;

keyword storing means for storing the set keyword;

judging means for, when a message is received, judging whether the received message contains the keyword stored in the keyword storing means or not; and controlling means for storing a received message which is judged by the judging means to contain the keyword, in the message storing means as distinguished from other received messages.

According to the invention, among received messages, a message containing the predetermined keyword is stored as distinguished from other received messages. Therefore, a received message of high importance can be stored as distinguished from other received messages, thereby improving the operability. Since the keyword can be arbitrarily set by the user, the kind of a message of high importance can be freely selected.

The invention is characterized in that:

the keyword storing means stores a plurality of keywords, the judging means judges whether the received message contains the keywords stored in the keyword storing means or not, and the controlling means stores only a received message which is judged by the judging means to contain all of the plurality of keywords, in the message storing means.

According to the invention, among received messages, only a message containing all of the plurality of predetermined keywords is stored. Therefore, only necessary messages can be selectively stored with the result that the operability is improved and the wasteful use of the memory capacity is reduced. Furthermore, a larger number of necessary received messages can be stored.

The invention is characterized in that the keyword storing means stores a plurality of keywords, the judging means judges whether the received message contains the keywords stored in the keyword storing means or not, and the controlling means stores a received message which is judged by the judging means to contain all of the plurality of keywords, in the message storing means as distinguished from other received messages.

According to the invention, among received messages, a received message containing all of the plural predetermined keywords is stored as distinguished from other received messages. Therefore, a received message of high importance can be stored as distinguished from other received messages, thereby improving the operability.

The invention is characterized in that:

the keyword storing means stores a plurality of keywords, the judging means judges whether the received message contains the keywords stored in the keyword storing means or not, and the controlling means stores only a received message which is judged by the judging means to contain at least one of the plurality of keywords, in the message storing means.

According to the invention, among received messages, only a message containing at least one of the plurality of predetermined keywords is stored. Therefore, only necessary messages can be selectively stored with the result that the operability is improved and the wasteful use of the memory capacity is reduced. Furthermore, a larger number of necessary received messages can be stored.

The invention is characterized in that:

the keyword storing means stores a plurality of keywords, the judging means judges whether the received message contains the keywords stored in the keyword storing means or not, and the controlling means stores a received message which is judged by the judging means to contain at least one of the plurality of keywords, in the message storing means as distinguished from other received messages.

According to the invention, among received messages, a received message containing at least one of the plurality of predetermined keywords is stored as distinguished from other received messages. Therefore, a received message of high importance can be stored as distinguished from other received messages, thereby improving the operability.

The invention is characterized in that:

the keyword storing means stores a plurality of keywords which are ordered in accordance with importance, the judging means judges whether the received message contains the keywords stored in the keyword storing means or not, the controlling means stores only a received message which is judged by the judging means to contain at least one of the plurality of keywords, in the message storing means, with classifying the received message according to the keyword, and the message storing means stores:

with respect to a first keyword of highest importance, all messages containing the first keyword in an area corresponding to the first keyword, and, with respect to keywords of second and subsequent importance, for a keyword of each importance, a message which is a message other than messages containing keywords of higher importance and contains the keyword of the importance, in areas respectively corresponding to the keywords of second and subsequent importance.

According to the invention, among received messages, only a message containing at least one of the plurality of predetermined keywords is stored. Therefore, only necessary messages can be selectively stored with the result that the operability is improved and the wasteful use of the memory capacity is reduced. Furthermore, a larger number of necessary messages can be stored.

The plural keywords are ordered in accordance with importance. Received messages are classified for each keyword, and stored according to importance of keyword so as not to be duplicated. As a result, the wasteful use of memory capacity can be reduced.

The invention is characterized in that the keyword storing means stores a plurality of keywords which are ordered in accordance with importance, the judging means judges whether the received message contains the keywords stored in the keyword storing means or not, the controlling means classifies a received message which is judged by the judging means to contain at least one of the plurality of keywords, for each keyword, as distinguished from other received messages, and stores the classified received message in the message storing means, and the message storing means stores, with respect to a first keyword of highest importance, all messages containing the first keyword, in an area corresponding to the first keyword, and, with respect to keywords of second and subsequent importance, for a keyword of each importance, a message which is one other than messages containing keywords of higher importance and contains the keyword of the importance, in areas respectively corresponding to the keywords of second and subsequent importance.

According to the invention, among received messages, a received message containing at least one of the plurality of predetermined keywords is stored as distinguished from other received messages. Therefore, a received message of high importance can be stored as distinguished from other received messages, thereby improving the operability.

The plural keywords are ordered in accordance with importance. Received messages are classified for each keyword, and stored according to importance of keyword so as not to be duplicated. As a result, the wasteful use of memory capacity can be reduced.

The invention is characterized in that:

the keyword storing means stores a plurality of keywords, the judging means judges whether the received message contains the keywords stored in the keyword storing means or not, the controlling means classifies only received messages which are judged by the judging means to contain at least one of the plurality of keywords, for each keyword, and stores the classified received messages in the message storing means, and the message storing means stores all messages containing a keyword, in an area respectively corresponding to the keyword.

According to the invention, among received messages, only messages containing at least one of the plurality of predetermined keywords are stored. Therefore, only necessary messages can be selectively stored with the result that the operability is improved and the wasteful use of memory capacity is reduced. Furthermore, a larger number of necessary received messages can be stored. All messages containing a keyword can be stored in an area respectively corresponding to the keyword.

The invention is characterized in that the keyword storing means stores a plurality of keywords, the judging means judges whether the received message contains the keywords stored in the keyword storing means or not, the controlling means classifies only received messages which are judged by the judging means to contain at least one of the plurality of keywords, for each keyword, and stores the classified received messages in the message storing means, and the message storing means stores all messages containing any keyword, in an area corresponding to the contained keyword.

According to the invention, among received messages, a message containing at least one of the plurality of predetermined keywords is stored as distinguished from other messages. Therefore, a received message of high importance can be stored as distinguished from other received messages, thereby improving the operability. All messages which contain any keyword can be stored in an area corresponding to the contained keyword.

The invention is characterized in that the receiver further comprises message displaying means for displaying a keyword of a message stored in the message storing means, with being highlighted by an attribute which is different from attributes for other words.

According to the invention, a received message is displayed on the message displaying means. At this time, the key word of the received message is displayed with being highlighted by an attribute which is different from attributtes for the other words. Therefore, the user can visually recognize the keyword.

The invention is characterized in that the receiver further comprises second keyword setting means for designating a character string of the received message, and setting the designated character string as a keyword.

According to the invention, a designated character string of a received message is set as a keyword. Therefore, the user can designate a keyword from a received message.

The invention is characterized in that the receiver further comprises:

keyword displaying means for displaying keywords stored in the keyword storing means;

keyword selecting means for selecting a predetermined keyword from the keywords displayed on the keyword displaying means; and message displaying means for selecting a message containing the keyword selected by the keyword selecting means, from the messages stored in the message storing means, and displaying the selected message.

According to the invention, preset keywords are displayed on the keyword displaying means, a predetermined keyword is selected, and a message containing the selected keyword is displayed on the message displaying means. Therefore, a message desired by the user can be displayed.

The invention is characterized in that the keyword displaying means displays the keywords stored in the keyword storing means, together with information indicative of presence or absence, or the number of unread messages which have not been displayed.

According to the invention, when the user selects a keyword, the user can know presence or absence, or the number of unread messages which have not been displayed.

The invention is characterized in that the receiver further comprises notifying means for notifying that there is an unread message which has not been displayed on the message displaying means.

According to the invention, the user can know that there is an unread message.

The invention is characterized in that the notifying means notifies that there is an unread message by a sound, a vibration amplitude or a vibration period which is differently set for each keyword.

According to the invention, the user can know that there is an unread message, by a sound, a vibration amplitude, or a vibration period which is differently set for each keyword.

BRIEF DESCRIPTION OF THE DRAWINGS

Other and further objects, features, and advantages of the invention will be more explicit from the following detailed description taken with reference to the drawings wherein:

FIG. 2 is a view showing a keyword storage table 35*a* of a keyword storing unit 35;

FIG. 3 is a view showing a temporary message storage table 36*a* of a temporary message storage buffer 36;

FIG. 27 is a view showing a message 15 which is transmitted configuration of a conventional paging receiver 1.

DETAILED DESCRIPTION OF THE PREFERRED EMBODIMENTS

Figure 1:
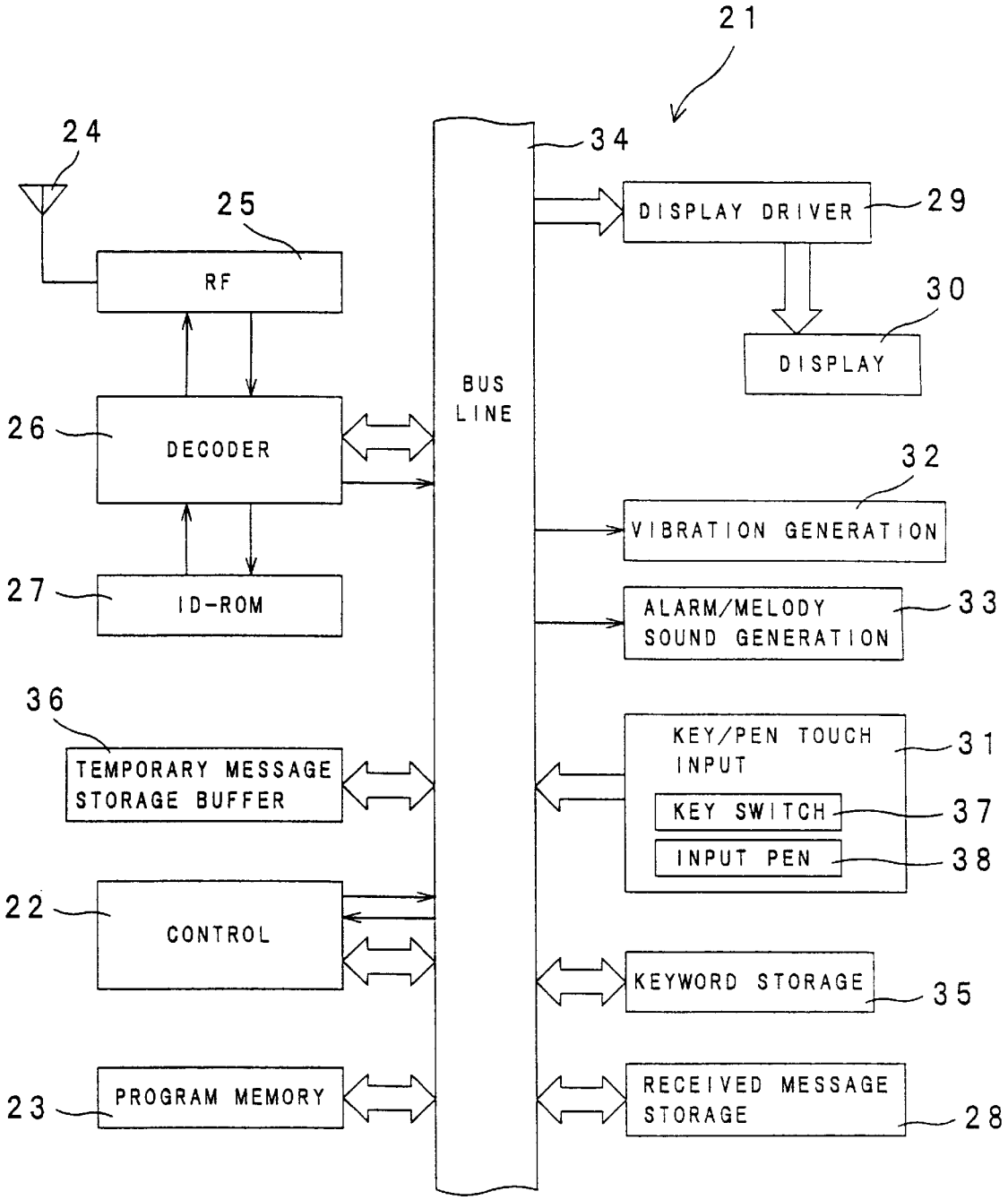
FIG. 1 is a block diagram showing the electrical configuration of a paging receiver 21 of a first embodiment of the invention.

Now referring to the drawings, preferred embodiments of the invention are described below.

FIG. 1 is a block diagram showing the electrical configuration of a paging receiver 21 of a first embodiment of the invention. The paging receiver 21 comprises a control unit 22, a program memory 23, an antenna 24, an RF unit 25, a decoder unit 26, an ID-ROM 27, a received message storing unit 28, an LCD driver 29, a displaying unit 30, a key/pen touch input unit 31, a vibration generating unit 32, an alarm/melody sound generating unit 33, a bus line 34, a keyword storing unit 35, and a temporary message storage buffer 36.

A signal transmitted from an information service carrier by wireless transmission or the like is received by the antenna 24, and tuned and detected by the RF unit 25. The detected signal is demodulated and then supplied to the decoder unit 26.

In the decoder unit 26, a destination ID code is obtained from a pager format signal of, for example, the POCSAG system, and it is judged whether the ID code coincides with the own ID code stored in the ID-ROM 27 or not. If the codes coincide with each other, message information is obtained from a signal which is subsequently received. Furthermore, an interrupt signal indicative of reception of an effective signal is outputted.

In response to the interrupt signal, the control unit 22 which is realized by a CPU (central processing unit) or the like activates operation programs which are previously stored in the program memory 23 which is realized by a ROM (read only memory) or the like. The received message information is temporarily stored in the temporary message storage buffer 36 which is realized by a RAM (random access memory) or the like. A received message is selected by using a keyword which is previously stored in the keyword storing unit 35 which is realized by a flash memory, a RAM, or the like, and then stored in the received message storing unit 28 which is realized by a RAM or the like.

The received message can be displayed on the displaying unit 30 which is driven by the display driver 29. The displaying unit 30 is realized by, for example, an LCD (liquid crystal display).

The key/pen touch input unit 31 is realized by, for example, a tablet. Various processes such as deletion of a received message can be instructed by an input through an input pen 38 provided on the key/pen touch input unit 31. Also an input of a keyword can be executed by such an input. The key/pen touch input unit 31 has a key switch 37 for activating a function of registering a keyword which will be described later.

The vibration generating unit 32 notifies the user of reception of a message and the like, by a vibration. The alarm/melody sound generating unit 33 acoustically notifies of the reception.

The control unit 22, the program memory 23, the decoder unit 26, the received message storing unit 28, the display driver 29, the key/pen touch input unit 31, the vibration generating unit 32, the alarm/melody sound generating unit 33, the keyword storing unit 35, and the temporary message storage buffer 36 are electrically connected to each other via a bus line 34.

FIG. 2 is a view showing a keyword storage table 35*a* of the keyword storing unit 35. In the keyword storage table 35*a*, management numbers 41 are stored in correspondence with keywords 42. In the embodiment, notifying method code numbers 43 also are correspondingly stored.

A plurality of keywords 42 can be set until the stored contents of the keyword storage table 35*a* reaches the maximum memory capacity of the table. As described above, the user can set the keywords 42 by, for example, inputting character strings through the key/pen touch input unit 31. Alternatively, keywords may be set by another method. The keywords 42 are configured by words 42*a*, and an end symbol 42*b* which is placed behind the words 42*a* and which indicates the end of the keyword list.

Each notifying method code number 43 indicates the method by which the user is notified when a message containing the corresponding keyword 42 is received. For example, "1" indicates that reception is notified by a high alarm sound, indicates that reception is notified by a first melody sound, "6" indicates that reception is notified by a vibration, and "0" indicates that reception is not notified.

FIG. 3 is a view showing a temporary message storage table 36*a* of the temporary message storage buffer 36. A received message 44 is temporarily stored in the temporary message storage table 36*a*.

Figure 4:
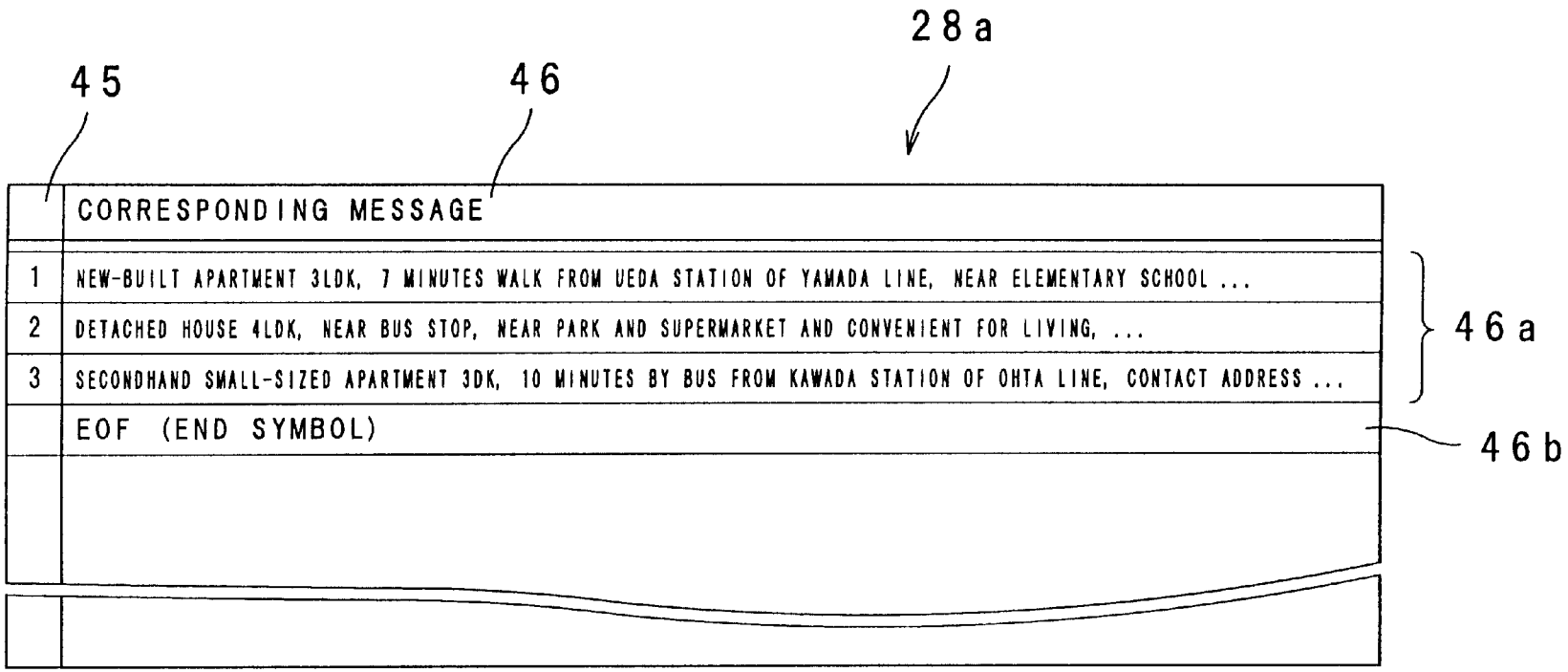
FIG. 4 is a view showing a received message storage table 28*a* of a received message storing unit 28.

FIG. 4 is a view showing a received message storage table 28*a* of the received message storing unit 28. In the received message storage table 28*a*, management numbers 45 are stored in correspondence with received messages 46.

A plurality of received messages 46 can be stored in accordance with the limit of the memory capacity of the received message storage table 28*a* and the lengths of the messages. The received messages 46 are configured by messages 46*a*, and an end symbol 46*b* which is placed behind the messages 46*a* and which indicates the end of the message list.

Figure 5:
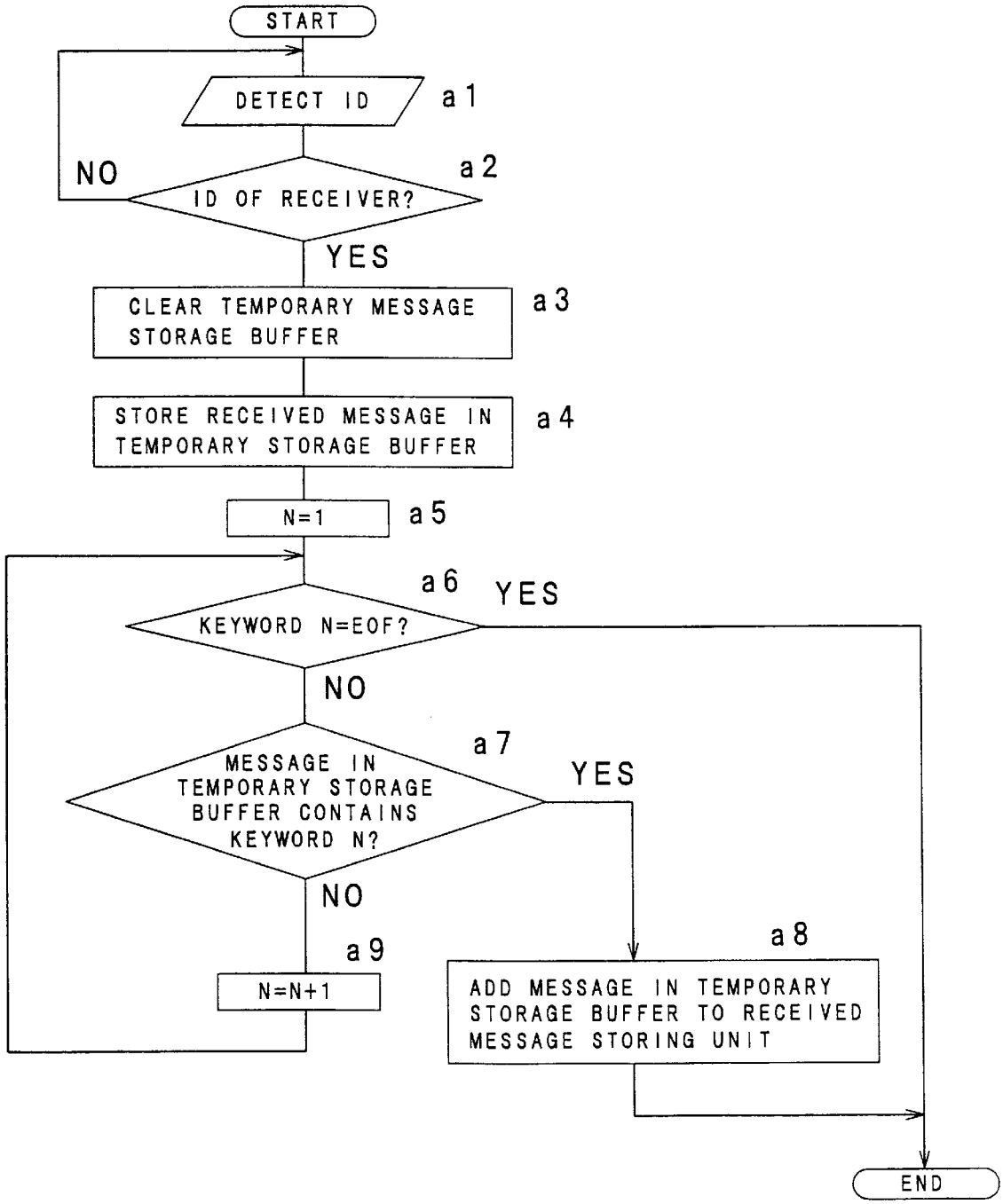
FIG. 5 is a flowchart showing an operation of storing a received message in the paging receiver 21.

FIG. 5 is a flowchart showing the operation of storing a received message in the paging receiver 21 of the first embodiment. In step a1, the decoder unit 26 detects the destination ID code from the signal which is received by the antenna 24, tuned and detected by the RF unit 25, and then demodulated. In step a2, the control unit 22 judges whether the detected ID code coincides with the own ID code stored in the ID-ROM 27 or not. If the codes coincide with each other, the control advances to step a3. If the codes do not coincide with each other, the control returns to step a1.

In step a3, the stored contents of the temporary message storage table 36*a* of the temporary message storage buffer 36 are cleared. In step a4, message information is obtained from a signal which is subsequently received, and the information is temporarily stored in the temporary message storage table 36*a*. In step a5, a parameter N is set to be 1.

In step a6, the control unit 22 judges whether an N-th keyword stored in the keyword storage table 35*a* is the end symbol 42*b* or not. If the keyword is the end symbol 42*b*, the operation of storing the received message is ended. If the keyword is not the end symbol 42*b*, the control advances to step a7.

In step a7, the control unit 22 judges whether the received message stored in the temporary message storage table 36*a* contains the N-th keyword or not. If the keyword is contained, the control advances to step a8. If the keyword is not contained, the control advances to step a9 to set the parameter N to be N+1 and the control then returns to step a6.

In step a8, the received message stored in the temporary message storage table 36*a* is additionally stored in the received message storage table 28*a* of the received message storing unit 28. Then the operation of storing the received message is ended.

As described above, according to the first embodiment, only a received message 46 which is the received message 44 temporarily stored in the temporary message storage table 36*a* of the temporary message storage buffer 36 and which contains at least one of the keywords 42 that are previously set by the user is stored in the received message storage table 28*a* of the received message storing unit 28.

Therefore, a necessary received message can be selectively stored, and cumbersome operations of separating unnecessary messages from necessary ones and deleting the unnecessary messages are not required, thereby improving the operability. Furthermore, the wasteful use of the memory capacity of the received message storing unit 28 is reduced, and hence a larger number of necessary received messages can be stored. Since the keywords 42 can be arbitrarily set by the user, the kind of a message to be stored can be freely selected.

The following configuration also is in the scope of the invention. A plurality of keywords are ordered in accordance with importance. With respect to a first keyword of highest importance, all received messages containing the first keyword are stored in a predetermined area of the received message storage table 28*a* corresponding to the first keyword. With respect to keywords of second and subsequent importance, for a keyword of each importance, a received message which does not contain a keyword of higher importance and which contains the keyword of the importance is stored in a predetermined area of the received message storage table 28*a* corresponding to the keywords of second and subsequent importance.

Specifically, the case where first to third keywords A, B, and C are set in the order of importance of A>B>C will be considered. With respect to the first keyword A, messages of A, A+B, A+C, and A+B+C are stored in a predetermined area. With respect to the second keyword B, messages of B and B+C are stored in a predetermined area. With respect to the third keyword C, only a message C is stored in a predetermined area. According to this configuration, received messages are stored with being classified according to the keyword, and the messages can be stored in accordance with importance of the keyword, so as not be duplicated. As a result, the wasteful use of the memory capacity can be further reduced.

Next, a paging receiver of a second embodiment of the invention will be described. In the paging receiver 21 of the first embodiment, only the received message 46 which contains at least one of the plural preset keywords 42 is stored. By contrast, in the paging receiver of the second embodiment, a received message which contains at least one of the plural preset keywords 42, and other received messages are stored in respective predetermined areas of the received message storage table 28*a* of the received message storing unit 28. The block diagram of the embodiment is identical with that of FIG. 1. Therefore, description of the components is omitted and the components are designated by the same reference numerals.

Figure 6:
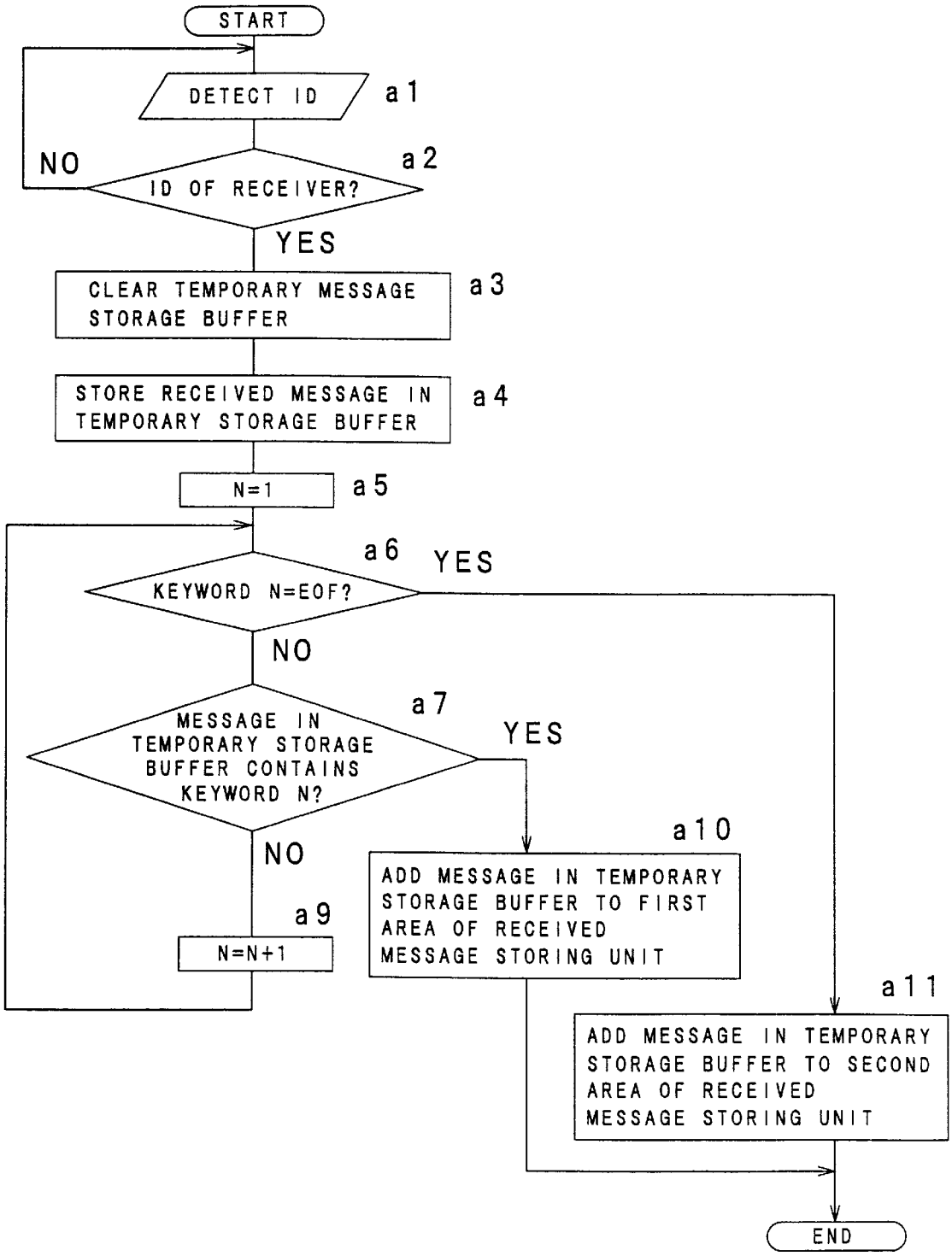
FIG. 6 is a flowchart showing an operation of storing a received message in the paging receiver 21 of a second embodiment of the invention.

FIG. 6 is a flowchart showing an operation of storing a received message in the paging receiver 21 of the second embodiment. The flowchart is configured by deleting step a8 of the flowchart of FIG. 5 and adding steps a10 and a11. The description of the same steps is omitted.

In step a6, the control unit 22 judges whether the N-th keyword stored in the keyword storage table 35*a* is the end symbol 42*b* or not. If the keyword is the end symbol 42*b*, the control advances to step a11. If the keyword is not the end symbol 42*b*, the control advances to step a7.

In step a7, the control unit 22 judges whether the received message stored in the temporary message storage table 36*a* contains the N-th keyword or not. If the keyword is contained, the control advances to step a10. If the keyword is not contained, the control advances to step a9 to set the parameter N to be N+1 and the control then returns to step a6.

In step a10, the received message stored in the temporary message storage table 36*a* is additionally stored in the first area of the received message storage table 28*a*. Then the operation of storing the received message is ended.

In step a11, the received message stored in the temporary message storage table 36*a* is additionally stored in a second area of the received message storage table 28*a* which is different from the first area. Then the operation of storing the received message is ended.

As described above, according to the second embodiment, the received message 46 which is the received message 44 temporarily stored in the temporary message storage table 36*a* and which contains at least one of the plural keywords 42 that are previously set by the user, and another received message 46 are stored as distinguished from each other, in the received message storage table 28*a* of the received message storing unit 28.

Therefore, a necessary received message can be stored as distinguished from other received messages, and cumbersome operations of separating unnecessary messages from necessary ones and deleting the unnecessary messages are not required, thereby improving the operability. Since the keywords 42 can be arbitrarily set by the user, the kind of a message to be stored can be freely selected.

In the same manner as the first embodiment, also the configuration in which a plurality of keywords are ordered in accordance with importance, received messages are stored with being classified according to the keyword, and messages are stored in accordance with importance of the keyword, so as not to be duplicated, thereby reducing a wasteful use of the memory capacity is in the scope of the invention.

Next, a paging receiver of a third embodiment of the invention will be described. In the paging receiver 21 of the first embodiment, only the received message 46 which contains at least one of the plural preset keywords 42 is stored. By contrast, in the paging receiver of the third embodiment, only a received message which contains all the plural preset keywords 42 is stored. The block diagram of the embodiment is identical with that of FIG. 1. Therefore, description of the components is omitted and the components are designated by the same reference numerals.

Figure 7:
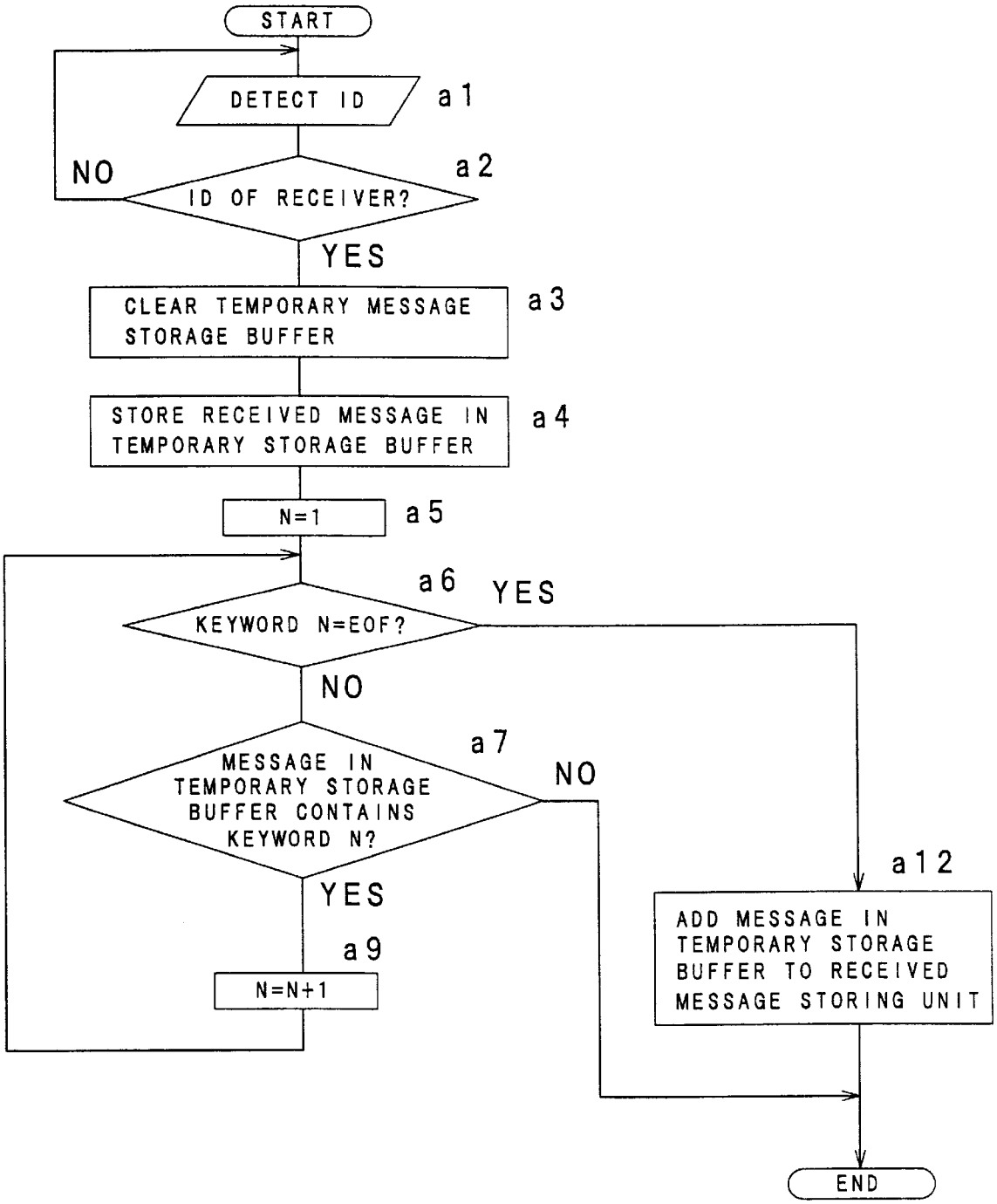
FIG. 7 is a flowchart showing an operation of storing a received message in the paging receiver 21 of a third embodiment of the invention.

FIG. 7 is a flowchart showing an operation of storing a received message in the paging receiver 21 of the third embodiment. The flowchart is configured by deleting step a8 of the flowchart of FIG. 5 and adding step a12. The description of the same steps is omitted.

In step a6, the control unit 22 judges whether the N-th keyword stored in the keyword storage table 35*a* is the end symbol 42*b* or not. If the keyword is the end symbol 42*b*, the control advances to step a12. If the keyword is not the end symbol 42*b*, the control advances to step a7.

In step a7, the control unit 22 judges whether the received message stored in the temporary message storage table 36*a* contains the N-th keyword or not. If the keyword is contained, the control advances to step a9 to set the parameter N to be N+1 and the control then returns to step a6. If the keyword is not contained, the operation of storing the received message is ended.

In step a12, the received message stored in the temporary message storage table 36*a* is additionally stored in the received message storage table 28*a* of the received message storing unit 28. Then the operation of storing the received message is ended.

As described above, according to the third embodiment, only the received message 46 which is the received message 44 temporarily stored in the temporary message storage table 36*a* and which contains all the plural keywords 42 that are previously set by the user is stored in the received message storage table 28*a* of the received message storing unit 28. Therefore, the embodiment can attain the same effects as those of the first embodiment.

Next, a paging receiver of a fourth embodiment of the invention will be described. In the paging receiver 21 of the second embodiment, a received message 46 which contains at least one of the plural preset keywords 42, and other received messages 46 are stored as distinguished from each other. By contrast, in the paging receiver of the fourth embodiment, a received message which contains all the plural preset keywords 42, and other received messages are stored in respective predetermined areas of the received message storage table 28*a* of the received message storing unit 28. The block diagram of the embodiment is identical with that of FIG. 1. Therefore, description of the components is omitted and the components are designated by the same reference numerals.

Figure 8:
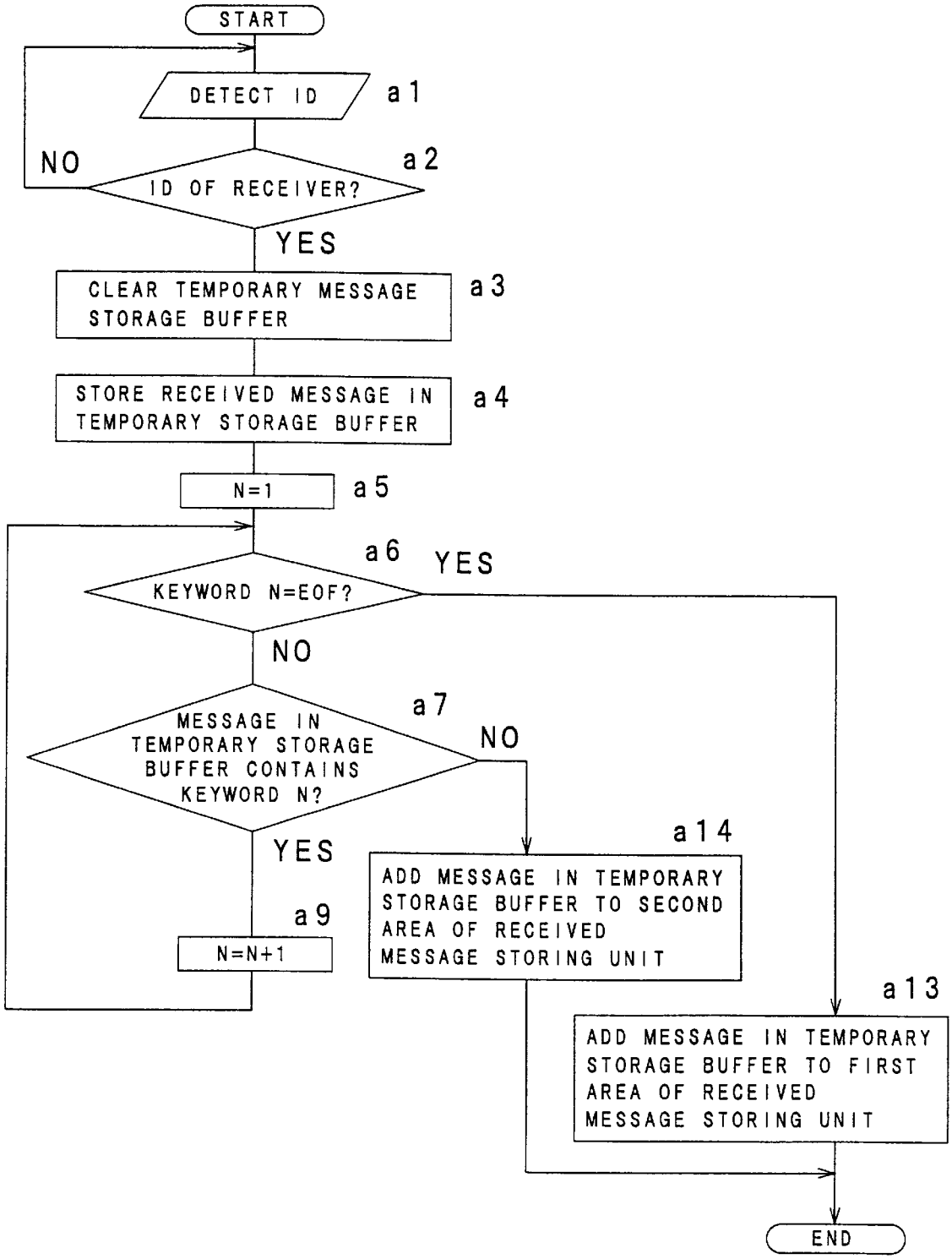
FIG. 8 is a flowchart showing an operation of storing a received message in the paging receiver 21 of a fourth embodiment of the invention.

FIG. 8 is a flowchart showing an operation of storing a received message in the paging receiver 21 of the fourth embodiment. The flowchart is configured by deleting step a8 of the flowchart of FIG. 5 and adding steps a13 and a14. The description of the same steps is omitted.

In step a6, the control unit 22 judges whether the N-th keyword stored in the keyword storage table 35*a* is the end symbol 42*b* or not. If the keyword is the end symbol 42*b*, the control advances to step a13. If the keyword is not the end symbol 42*b*, the control advances to step a7.

In step a7, the control unit 22 judges whether the received message stored in the temporary message storage table 36*a* contains the N-th keyword or not. If the keyword is contained, the control advances to step a9 to set the parameter N to be N+1 and the control then returns to step a6. If the keyword is not contained, the control advances to step a14.

In step a13, the received message stored in the temporary message storage table 36*a* is additionally stored in a first area of the received message storage table 28*a* of the received message storing unit 28. Then the operation of storing the received message is ended.

In step a14, the received message stored in the temporary message storage table 36*a* is additionally stored in a second area of the received message storage table 28*a* which is different from the first area. Then the operation of storing the received message is ended.

As described above, according to the fourth embodiment, the received message 46 which is the received message 44 temporarily stored in the temporary message storage table 36*a* and which contains all the plural keywords 42 that are previously set by the user, and other received messages 46 are stored as distinguished from each other, in the received message storage table 28*a* of the received message storing unit 28. Therefore, the embodiment can attain the same effects as those of the second embodiment.

Next, a paging receiver of a fifth embodiment of the invention will be described. In the paging receiver of the fifth embodiment, only a received message which contains at least one of plural preset keywords is stored, and the received message is stored in correspondence with all the corresponding keywords. In order to reduce the memory capacity, each keyword is stored in the form of a keyword management number.

Specifically, in the paging receiver of the fifth embodiment, the temporary message storage buffer 36 has a temporary message storage table 36*b* in place of the temporary message storage table 36*a*, and the received message storing unit 28 has a received message storage table 28*b* in place of the received message storage table 28*a*. The block diagram of the embodiment is identical with that of FIG. 1. Therefore, description of the components is omitted and the components are designated by the same reference numerals.

Figure 9:
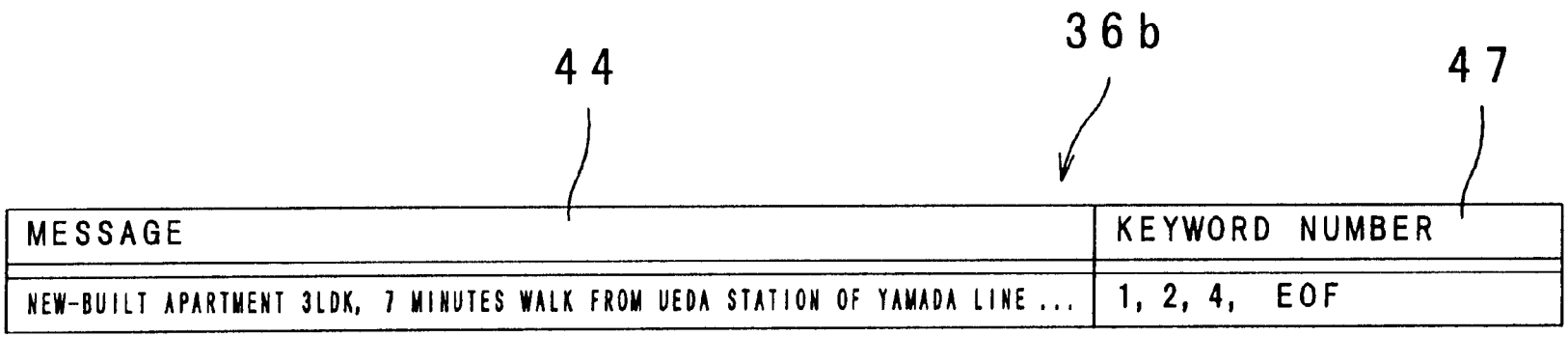
FIG. 9 is a view showing a temporary message storage table 36*b* of the temporary message storage buffer 36 of the paging receiver 21 of a fifth embodiment of the invention.

FIG. 9 is a view showing the temporary message storage table 36*b* of the temporary message storage buffer 36 of the paging receiver 21 of the fifth embodiment. In the temporary message storage table 36*b*, the received message 44 is temporarily stored, and keywords contained in the received message 44 are stored as keyword numbers 47 in a correspondence manner. The keyword numbers 47 correspond to the management numbers 41 of the keyword storage table 35*a* shown in FIG. 2.

Figure 10:
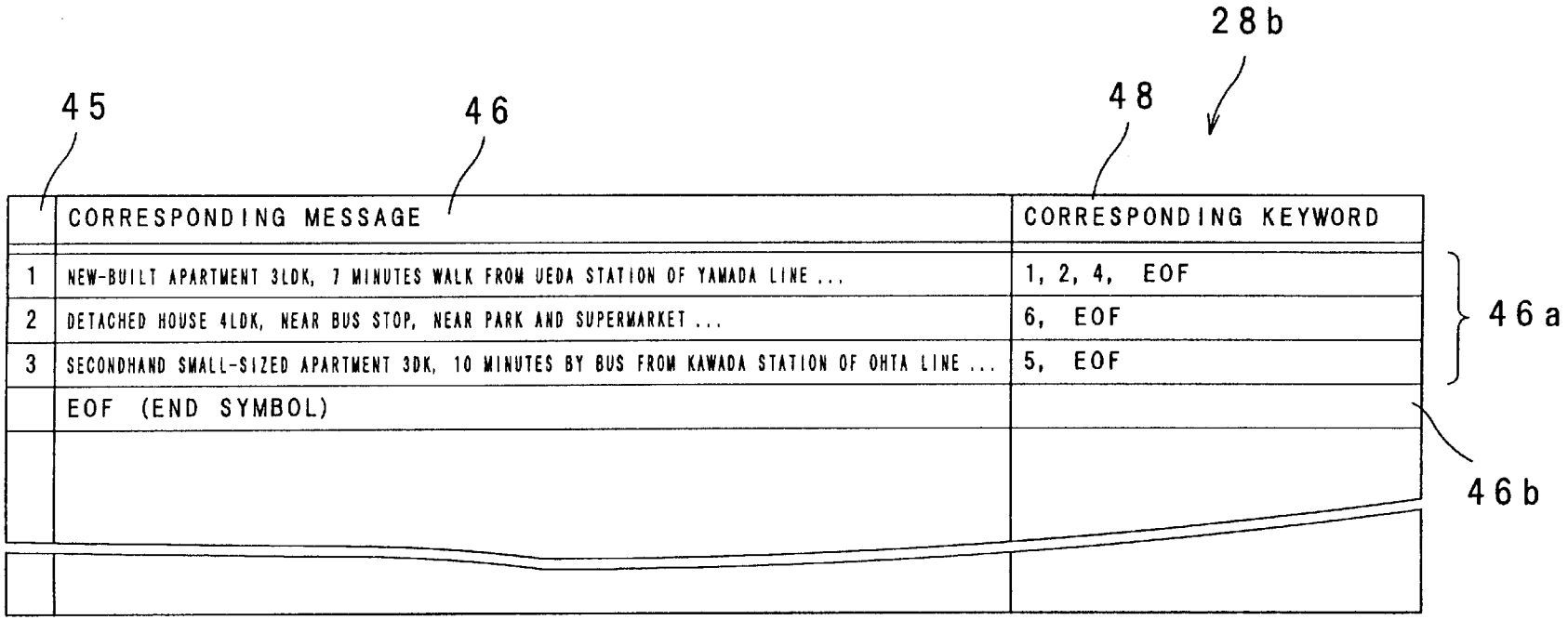
FIG. 10 is a view showing a received message storage table 28*b* of the received message storing unit 28 of the paging receiver 21 of the fifth embodiment.

FIG. 10 is a view showing the received message storage table 28*b* of the received message storing unit 28 of the paging receiver 21 of the fifth embodiment. In the received message storage table 28*b*, the management numbers 45 are stored in correspondence with the received messages 46. Only the received messages 46 which contain at least one of the plural preset keywords are stored. Furthermore, keywords contained in the respective received messages 46 are stored as corresponding keywords 48 in a correspondence manner. The corresponding keywords 48 also correspond to the management numbers 41 of the keyword storage table 35*a* shown in FIG. 2.

Figure 11:
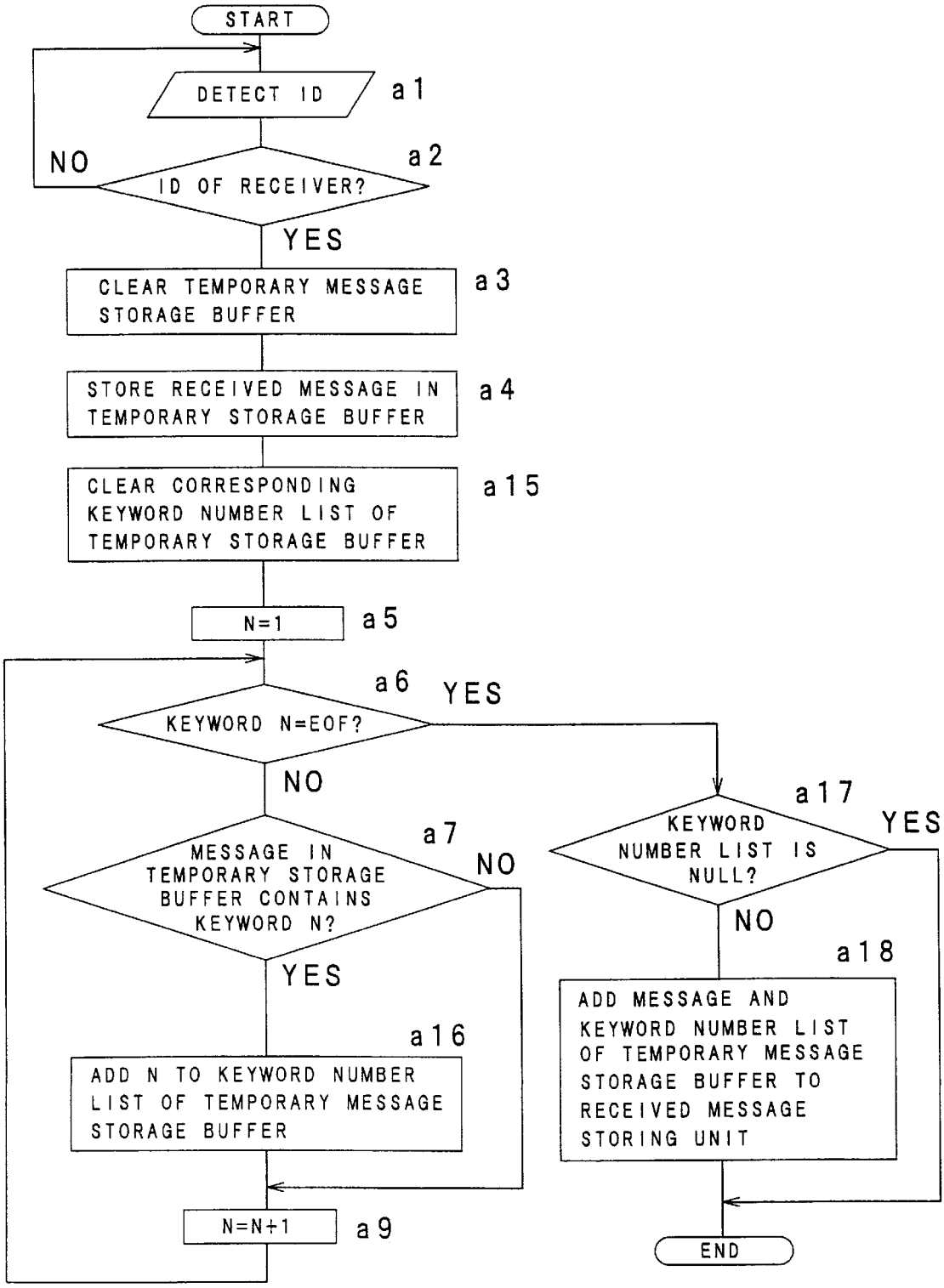
FIG. 11 is a flowchart showing an operation of storing a received message in the paging receiver 21 of the fifth embodiment.

FIG. 11 is a flowchart showing an operation of storing a received message in the paging receiver 21 of the fifth embodiment. The flowchart is configured by deleting step a8 of the flowchart of FIG. 5 and adding steps a15 to a18. The description of the same steps is omitted.

In step a4, message information is obtained from a signal which is subsequently received, and the information is temporarily stored in the temporary message storage table 36*a* of the temporary storage buffer 36. The control then advances to step a15 to clear the stored contents of the keyword numbers 47 of the temporary message storage table 36*b*. The control then advances to step a5 to set the parameter N to be 1.

In step a6, the control unit 22 judges whether the N-th keyword stored In the keyword storage table 35*a* is the end symbol 42*b* or not. If the keyword is the end symbol 42*b*, the control advances to step a17. If the keyword is not the end symbol 42*b*, the control advances to step a7.

In step a7, the control unit 22 judges whether the received message stored in the temporary message storage table 36*b* contains the N-th keyword or not. If the keyword is contained, the control advances to step a16 in which the number of the N-th keyword is additionally stored in the keyword numbers 47 of the temporary message storage table 36*b*. The control then advances to step a9. If the keyword is not contained, the control advances to step a9 without conducting any process. In step a9, the parameter N is set to be N+1, and the control then returns to step a6.

In step a17, the control unit 22 judges whether the keyword number 47 is empty or null. If the number is not null, the control advances to step a18 in which the received message stored in the temporary message storage table 36*b* is additionally stored in the received message storage table 28*b* of the received message storing unit 28. Then the operation of storing the received message is ended. At this time, the keyword number 47 also is additionally stored as a corresponding keyword 48. If the number is null, the operation of storing the received message is ended without conducting any process.

As described above, according to the fifth embodiment, only the received message 46 which contains at least one of the plural keywords 42 that are previously set by the user is additionally stored in the received message storage table 28*b*, in correspondence with all the corresponding keywords.

Specifically, the case where first to third keywords A, B, and C are set will be considered. With respect to the first keyword A, messages of A, A+B, A+C, and A+B+C are stored in a predetermined area. With respect to the second keyword B, messages of B, B+A, B+C, and B+A+C are stored in a predetermined area. With respect to the third keyword C, messages C, C+A, C+B, and C+A+B are stored in a predetermined area.

In the embodiment, a keyword is stored according to the management number of the keyword. Therefore, the wasteful use of the memory capacity can be reduced.

Next, a paging receiver of a sixth embodiment of the invention will be described. In the paging receiver 21 of the sixth embodiment, a received message which contains at least one of plural preset keywords is stored as distinguished from other received messages, and a received message which contains at least one of plural preset keywords is stored, in correspondence with all the corresponding keywords. In order to reduce the memory capacity, each keyword is stored in the form of a keyword management number in the same manner as the fifth embodiment.

Specifically, in the paging receiver of the sixth embodiment, in the same manner as the fifth embodiment, the temporary message storage buffer 36 has the temporary message storage table 36*b*, and the received message storing unit 28 has the received message storage table 28*c*. The block diagram of the embodiment is identical with that of FIG. 1. Therefore, description of the components is omitted and the components are designated by the same reference numerals.

Figure 12:
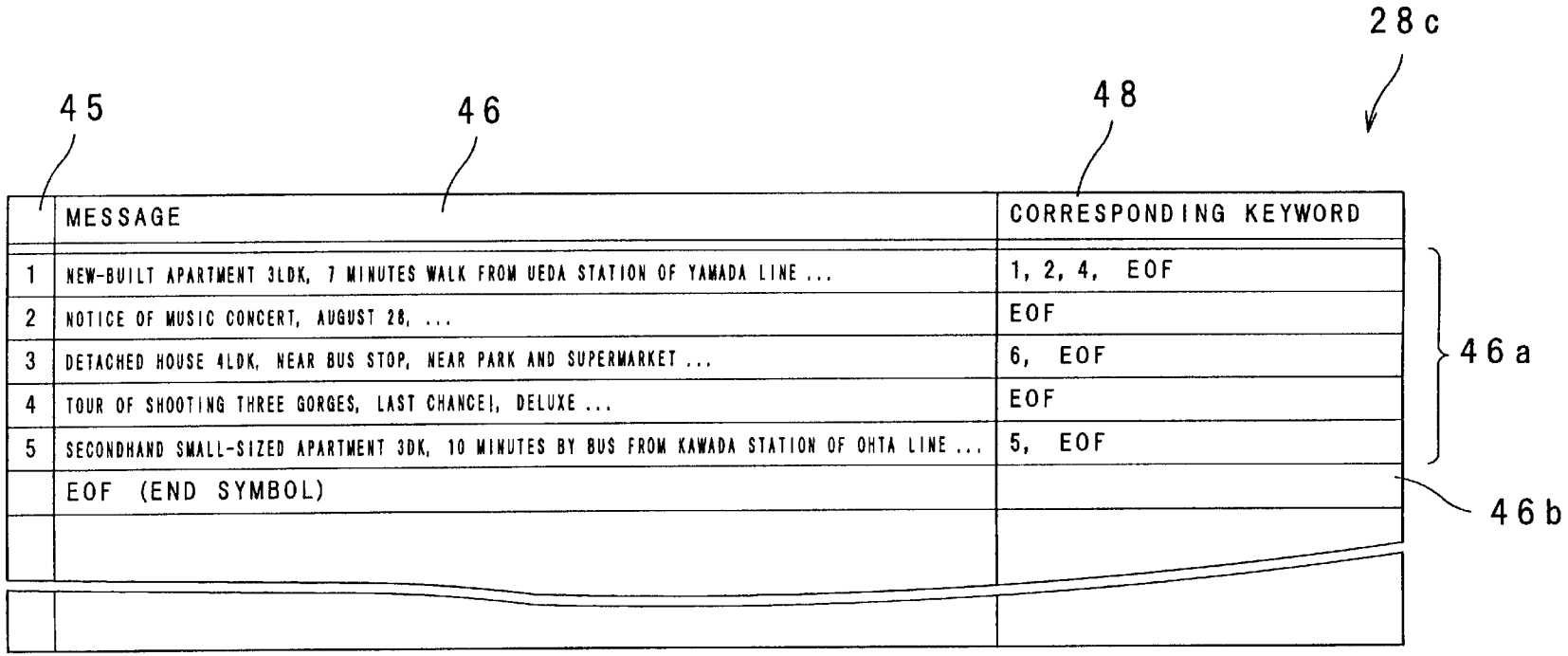
FIG. 12 is a view showing a received message storage table 28*c* of the received message storing unit 28 of the paging receiver 21 of a sixth embodiment of the invention.

FIG. 12 is a view showing the received message storage table 28*c* of the received message storing unit 28 of the paging receiver 21 of the sixth embodiment. In the received message storage table 28*c*, the management numbers 45 are stored in correspondence with the received messages 46. The received messages 46 consist of received messages which contain at least one of the plural preset keywords, and other received messages. These received messages are stored as distinguished from each other. Furthermore, keywords contained in the respective received messages 46 are stored as corresponding keywords 48 in a correspondence manner. The corresponding keywords 48 correspond to the management numbers 41 of the keyword storage table 35*a* shown in FIG. 2.

Figure 13:
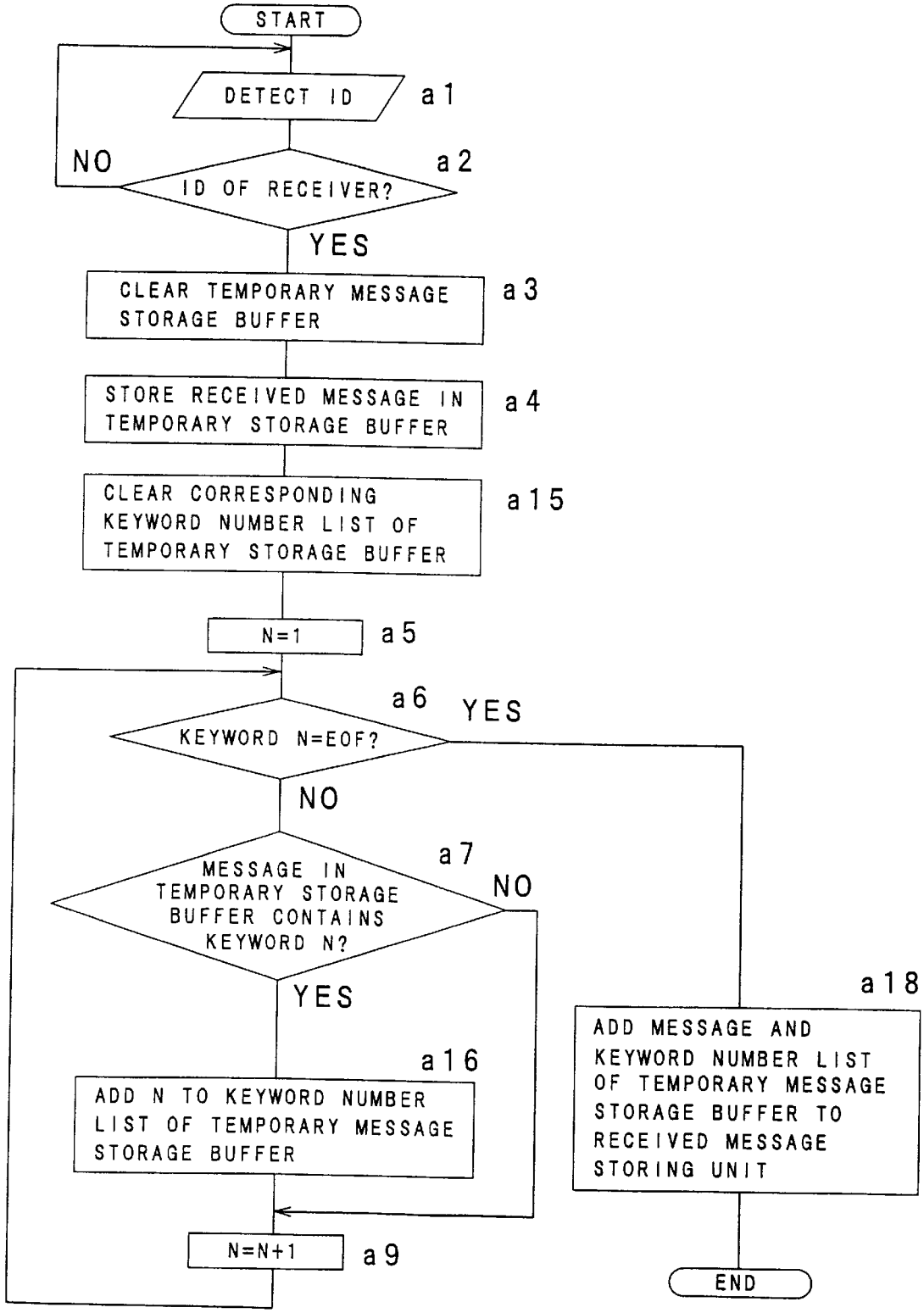
FIG. 13 is a flowchart showing an operation of storing a received message in the paging receiver 21 of the sixth embodiment.

FIG. 13 is a flowchart showing an operation of storing a received message in the paging receiver 21 of the sixth embodiment. The flowchart is configured by deleting step a17 of the flowchart of FIG. 11. The description of the same steps is omitted.

In step a6, the control unit 22 judges whether the N-th keyword stored in the keyword storage table 35*a* is the end symbol 42*b* or not. If the keyword is the end symbol 42*b*, the control advances to step a18. If the keyword is not the end symbol 42*b*, the control advances to step a7.

In step a18, a received message stored in the temporary message storage table 36*b* of the temporary storage buffer 36 is additionally stored in the received message storage table 28*c* of the received message storing unit 28. Then the operation of storing the received message is ended. At this time, the keyword number 47 also is additionally stored as a corresponding keyword 48.

As described above, according to the sixth embodiment, the received message 46 which contains at least one of the plural keywords 42 that are previously set by the user, and another received message 46 are stored as distinguished from each other, and, in the same manner as the fifth embodiment, additionally stored in the received message storage table 28*c* in correspondence with all the corresponding keywords 48. At this time, a keyword is stored according to the management number of the keyword. Therefore, the wasteful use of the memory capacity can be reduced.

Next, a paging receiver of a seventh embodiment of the invention will be described. The paging receiver of the seventh embodiment is characterized in the display of a received message. An example in which the embodiment is applied to the paging receiver 21 of the first embodiment will be described.

Figure 14A:
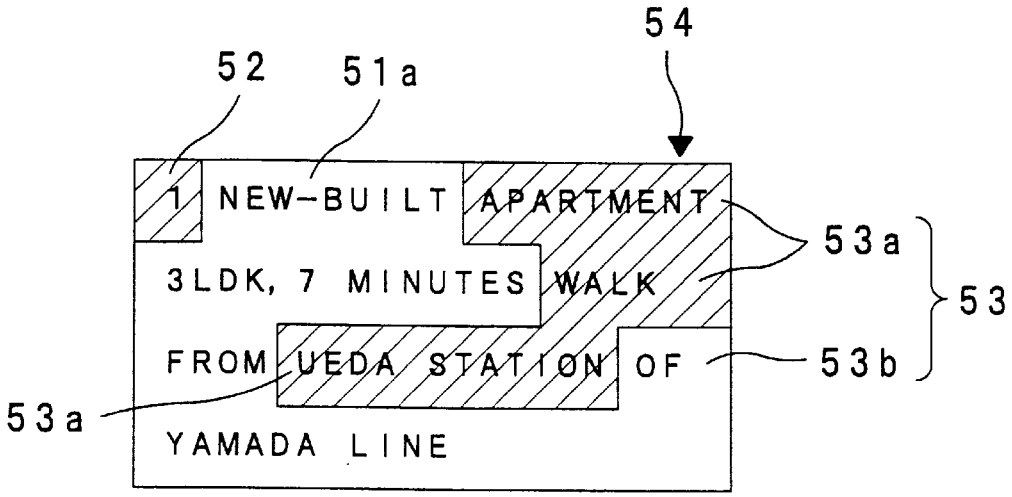
FIG. 14A is a view showing a manner of displaying a received message 46 stored in the received message storage table 28*a* of the received message storing unit 28 of the paging receiver 21 of a seventh embodiment of the invention, on a displaying unit 30.
Figure 14B:
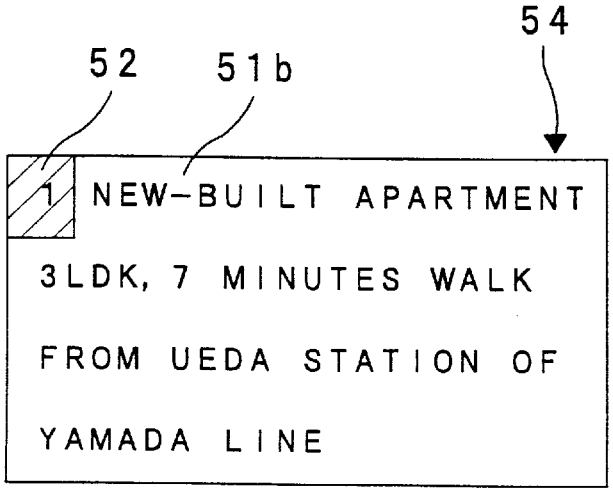
FIG. 14B is a view showing a manner of displaying a received message in a conventional paging receiver.

FIG. 14A is a view showing a manner of displaying a received message 46 stored in the received message storage table 28*a* of the received message storing unit 28 of the paging receiver 21 of the seventh embodiment, on the displaying unit 30, and FIG. 14B is a view showing a manner of displaying a received message in a conventional paging receiver.

The whole of data to be displayed consists of a message number 52 corresponding to the management number 45, a message 53 corresponding to the received message 46, and the reception date and time (not shown). Since the display capacity of the displaying unit 30 is limited, all the data are not always displayed. Therefore, the data are displayed in a split manner on a display screen 51*a* of the displaying unit 30. The display screen 51*a* is switched over by operating a display message movement button 54. When the screen is downward scrolled, the subsequent data can be displayed.

As shown in FIG. 14A, in the seventh embodiment, the message 53 is displayed in such a manner that the keywords 53*a* are highlighted or displayed in an attribute which is different from that for the other words 53*b*. When a monochromatic display is done, for example, the keywords 53*a* are displayed in a reversed manner. The message number 52 also may be displayed in a reversed manner.

As shown in FIG. 14B, in the a conventional paging receiver, the message is displayed in such a manner that the keywords and the other words are not distinguished from each other. In the embodiment, the keywords are highlighted, and hence the user can easily visually recognize the keywords.

Figure 15:
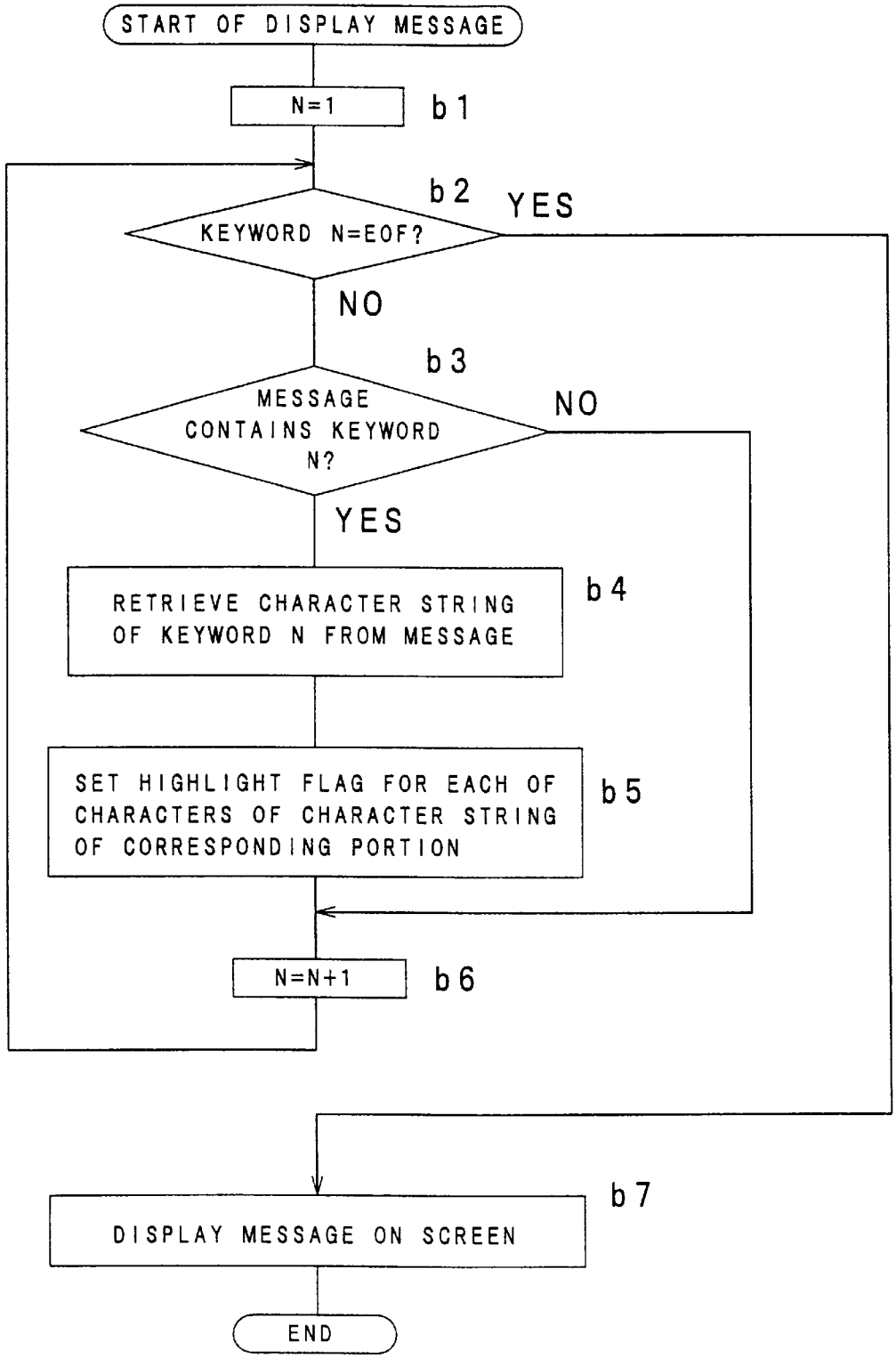
FIG. 15 is a flowchart showing an operation of displaying a received message in the paging receiver 21 of the seventh embodiment.

FIG. 15 is a flowchart showing an operation of displaying a received message in the paging receiver 21 of the seventh embodiment. In step b1, the parameter N is set to be 1. In step b2, it is judged whether the N-th keyword 42 stored in the keyword storage table 35*a* is the end symbol 42*b* or not. If the keyword is the end symbol 42*b*, the control advances to step b7 to display the received message on the displaying unit 30, and the operation is then ended. If the keyword is not the end symbol 42*b*, the control advances to step b3.

In step b3, it is judged whether the received message 46 stored in the received message storage table 28*a* contains the N-th keyword 42 or not. If the keyword is contained, the control advances to step b4. If the keyword is not contained, the control advances to step b6. In step b4, the character string of the N-th keyword 42 is retrieved from the received message 46. In step b5, a highlight flag is set for each of the characters of the corresponding portion. In step b6, the parameter N is set to be N+1, and the control then returns to step b2.

As described above, according to the seventh embodiment, the received message 53 is displayed on the displaying unit 30, and at this time the keywords 53*a* of the received message are displayed with being highlighted by an attribute which is different from that for the other words 53*b*. Therefore, the user can easily visually recognize the keywords.

Next, a paging receiver of an eighth embodiment of the invention will be described. The paging receiver of the eighth embodiment is characterized in that a keyword in a received message can be designated. An example in which the embodiment is applied to the paging receiver 21 of the first embodiment will be described.

Figure 16A:
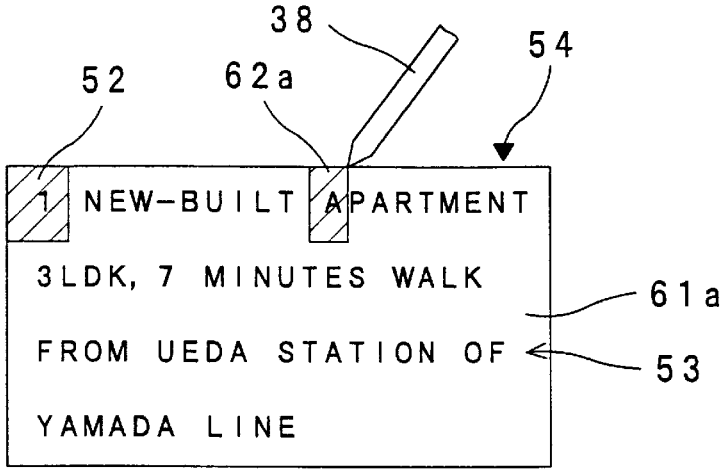
FIGS. 16A to 16C are views respectively showing display screens 61*a* to 61*c* which illustrate in stages a procedure of designating a keyword in the paging receiver 21 of an eighth embodiment of the invention.
Figure 16B:
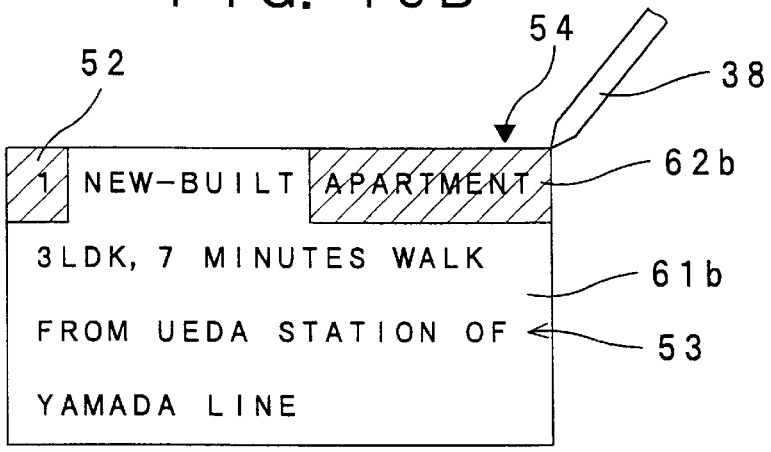
Figure 16C:
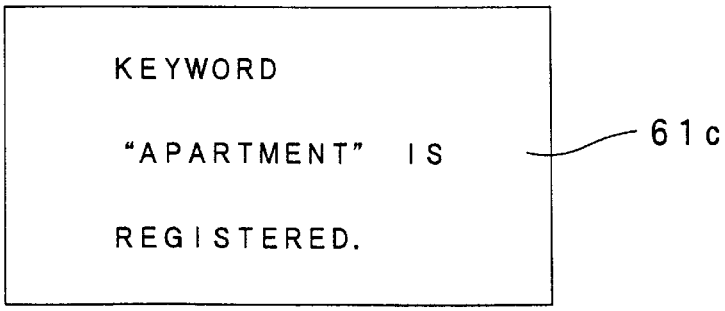

FIGS. 16A to 16C are views respectively showing display screens 61*a* to 61*c* which illustrate in stages a procedure of designating a keyword in the paging receiver 21 of the eighth embodiment.

On the display screen 61*a*, the received message 53 is displayed in succession to the message number 52. First, the execution of the function of registering a keyword is designated through the key switch 37 of the key/pen touch input unit 31. As shown in FIG. 16A, the initial character 62*a* of a character string which is to be set as a keyword is designated by using the input pen 38 of the key/pen touch input unit 31.

Next, as shown in FIG. 16B, the last character 62*b* of the character string which is to be set as a keyword is designated by using the input pen 38. When the character string of a keyword is designated in this way, information indicating that the character string designated as a keyword is registered is displayed as shown in FIG. 16C.

Figure 17:
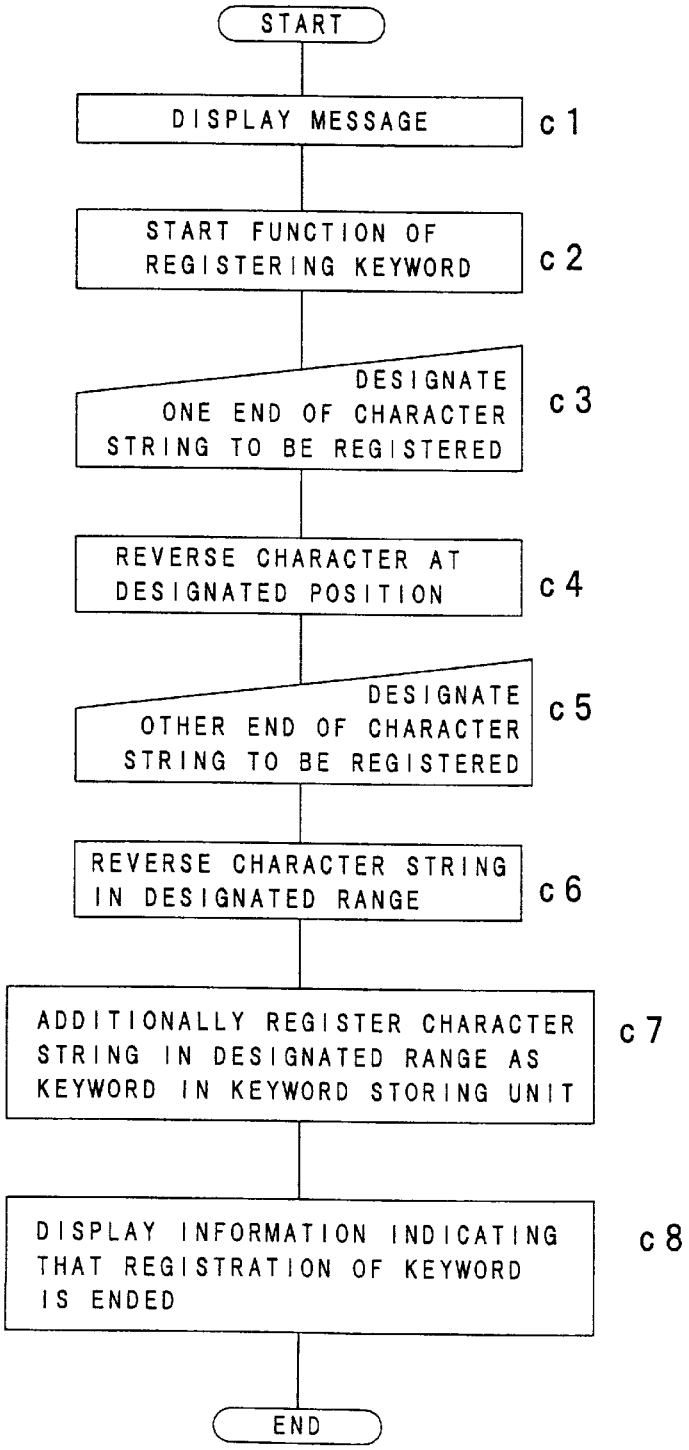
FIG. 17 is a flowchart showing an operation of designating a keyword in the paging receiver 21 of the eighth embodiment.

FIG. 17 is a flowchart showing an operation of designating a keyword in the paging receiver 21 of the eighth embodiment. In step c1, the received message 53 is displayed on the displaying unit 30. In step c2, the execution of the function of registering a keyword is designated through the key switch 37, and the execution of the function is started.

In step c3, the initial character 62*a* of a character string which is to be set as a keyword is designated by using the input pen 38. In step c4, the designated initial character 62*a* is highlighted or displayed in, for example, a reversed manner. In step c5, the last character 62*b* of the character string which is to be set as a keyword is designated by using the input pen 38. In step c6, the designated character string ranging from the initial character 62*a* to the last character 62*b* is highlighted.

In step c7, the designated character string is additionally stored as a new keyword in the keyword storage table 35*a* of the keyword storing unit 35. In step c8, information indicating that the registration of a keyword is ended is displayed, and the operation is ended.

As described above, according to the eighth embodiment, a designated character string which is designated in the received message 53 is set as a keyword. Therefore, the user can easily set a keyword from a received message.

Next, a paging receiver of a ninth embodiment of the invention will be described. The paging receiver of the ninth embodiment is characterized in that preset keywords are displayed on the displaying unit 30, a predetermined keyword can be selected, and a received message which contains the selected keyword can be displayed. An example in which the embodiment is applied to the paging receiver 21 of the first embodiment will be described.

Figure 18A:
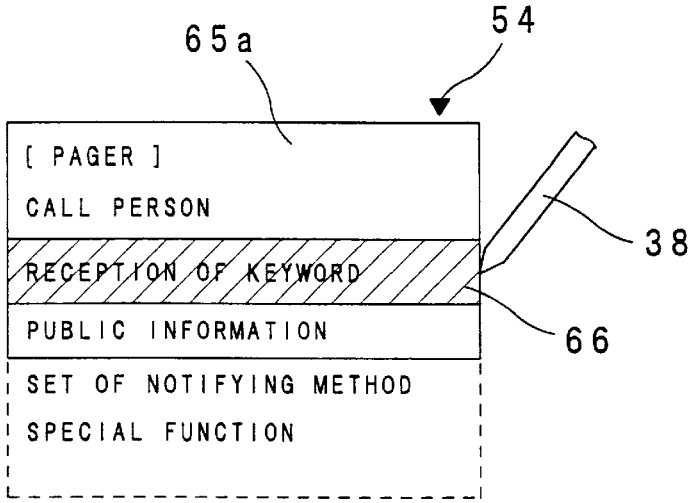
FIGS. 18A to 18C are views respectively showing display screens 65*a* to 65*c* which illustrate in stages a procedure of displaying a received message in the paging receiver 21 of a ninth embodiment of the invention.
Figure 18B:
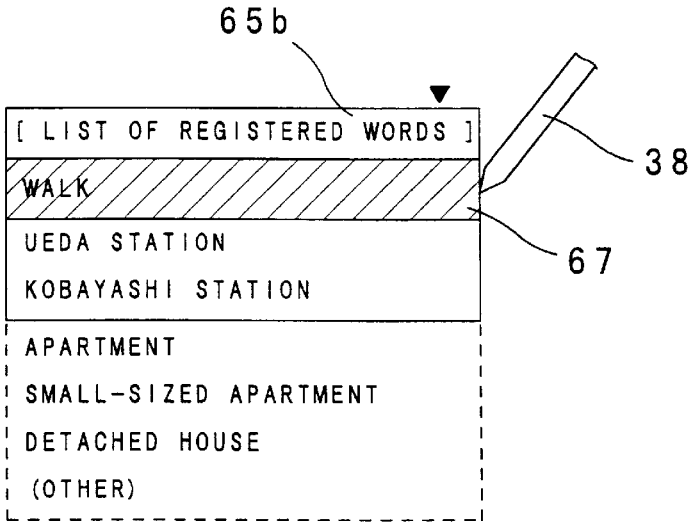
Figure 18C:
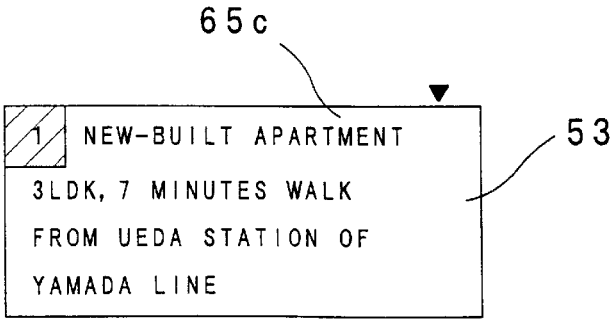

FIGS. 18A to 18C are views respectively showing display screens 65*a* to 65*c* which illustrate in stages a procedure of displaying a received message in the paging receiver 21 of the ninth embodiment.

In the initial state, the display screen 65*a* shown in FIG. 18A is displayed in order to designate the execution of one of various modes which are preset in the paging receiver 21. In this example, the execution of a keyword reception mode 66 for executing the above-mentioned function is designated by using the input pen 38.

The display screen 65*b* shown in FIG. 18B is then displayed to show a list of keywords. When a predetermined keyword 67 is designated by using the input pen 38, the display screen 65*c* shown in FIG. 18C indicating a received message which contains the keyword 67 is displayed.

Figure 19:
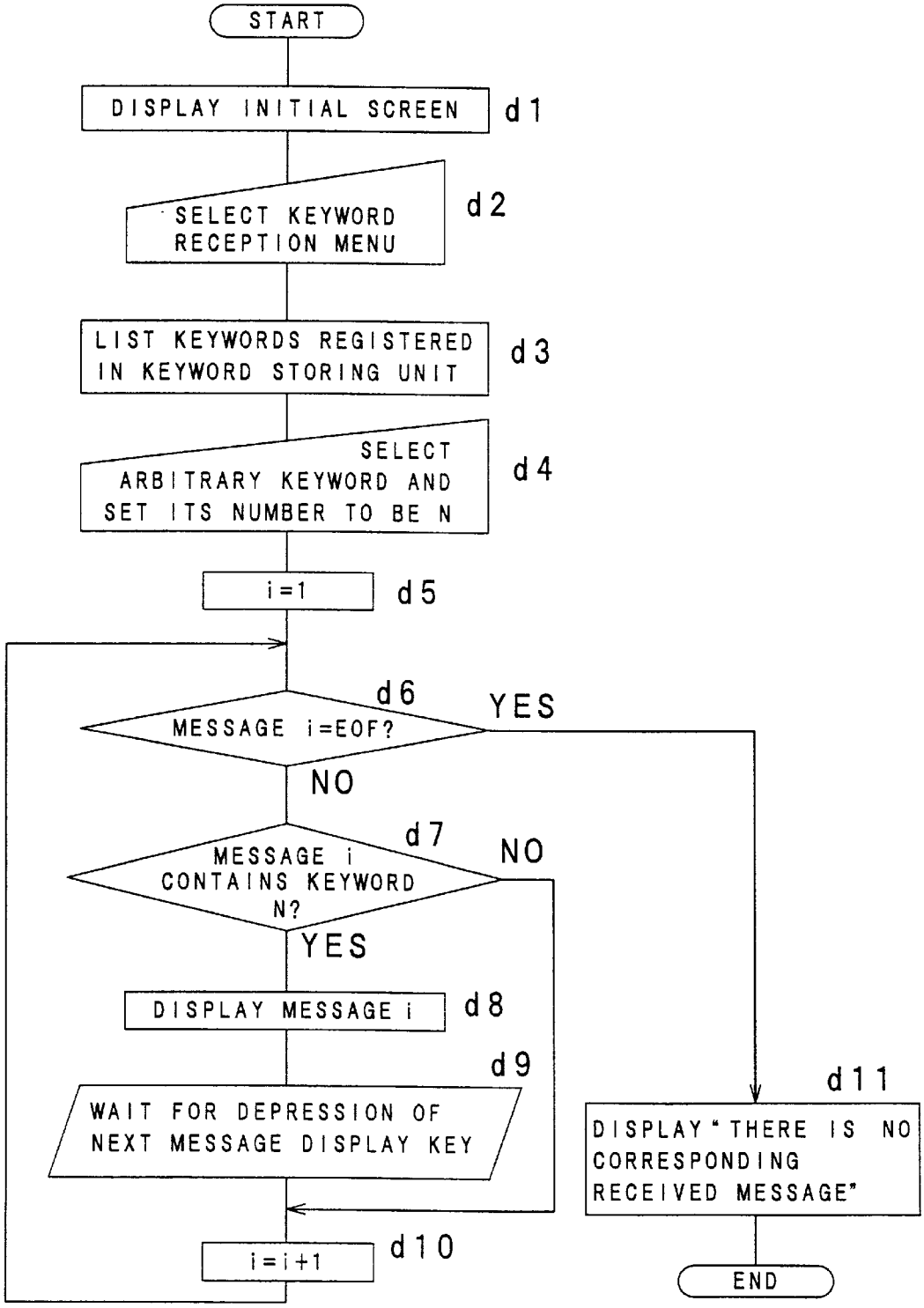
FIG. 19 is a flowchart showing an operation of displaying a received message in the paging receiver 21 of the ninth embodiment.

FIG. 19 is a flowchart showing an operation of displaying a received message in the paging receiver 21 of the ninth embodiment. In step d1, the initial display screen 65*a* is displayed. In step d2, the keyword reception mode 66 is selected to designate the execution of the mode. In step d3, the keywords 42 stored in the keyword storage table 35*a* of the keyword storing unit 35 are displayed in the form of a list on the display screen 65*b*.

In step d4, an arbitrary keyword is selected, and the number of the keyword is set to be N. In step d5, a parameter i is set to be 1. In step d6, it is judged whether an i-th received message 46 is the end symbol 46*b* or not. If the message is the end symbol 46*b*, the control advances to step d11 to display information indicating that there is no corresponding received message, and the operation is then ended. If the message is not the end symbol 46*b*, the control advances to step d7.

In step d7, it is judged whether the i-th received message 46 contains the N-th keyword 42 or not. If the message contains the keyword, the control advances to step d8 to display the i-th message 46, and then to step d9. When the display of the next message is instructed, the control advances to step d10. If the message does not contain the keyword, the control advances to step d10 without conducting any process. In step d10, the parameter i is set to be i+1, and the control then returns to step d6.

As described above, according to the ninth embodiment, keywords which are preset by the user are displayed, the predetermined keyword 67 is selected, and the received message(s) 53 which contains the selected keyword 67 is displayed on the displaying unit 30. Therefore, the received message(s) 53 which is desired by the user can be displayed.

Next, a paging receiver of a tenth embodiment of the invention will be described. The paging receiver of the tenth embodiment is characterized in that information indicative of presence or absence of or the number of unread messages which have not been displayed on the displaying unit 30 can be displayed. An example in which the embodiment is applied to the paging receiver 21 of the first embodiment will be described.

Figure 20A:
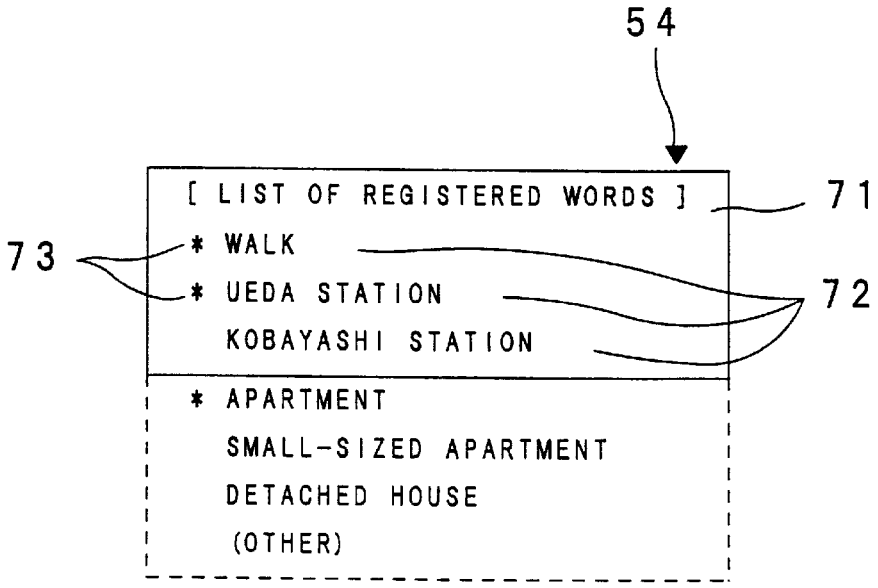
FIG. 20A is a view showing a display screen 71 which indicates whether there is an unread received message which has not been displayed on the displaying unit 30 of the paging receiver 21 of a tenth embodiment of the invention, or not.

FIG. 20A is a view showing a display screen 71 which indicates whether there is an unread received message which has not been displayed on the displaying unit 30 of the paging receiver 21 of the tenth embodiment, or not. In the tenth embodiment, in the case where the registered keywords are displayed in the form of a list, when there is an unread message for each of keywords 72, a predetermined symbol 73 is displayed.

Figure 20B:
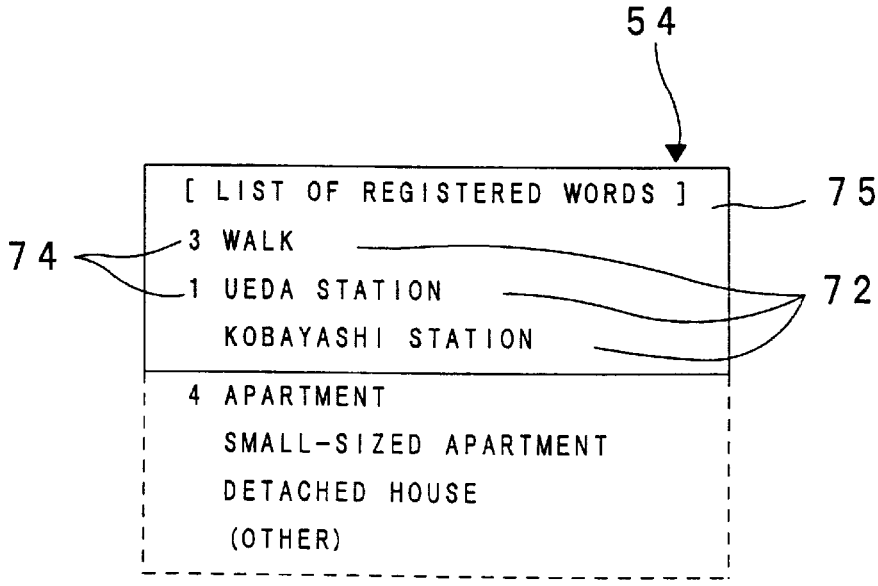
FIG. 20B is a view showing a display screen 75 which indicates the number of unread received messages.

FIG. 20B is a view showing a display screen 75 which indicates the number of unread received messages which have not been displayed on the displaying unit 30 of the paging receiver 21 of the tenth embodiment. In the tenth embodiment, in the case where the registered keywords are displayed in the form of a list, also the number 74 of unread received messages is displayed for each of the keywords 72.

Figure 21:
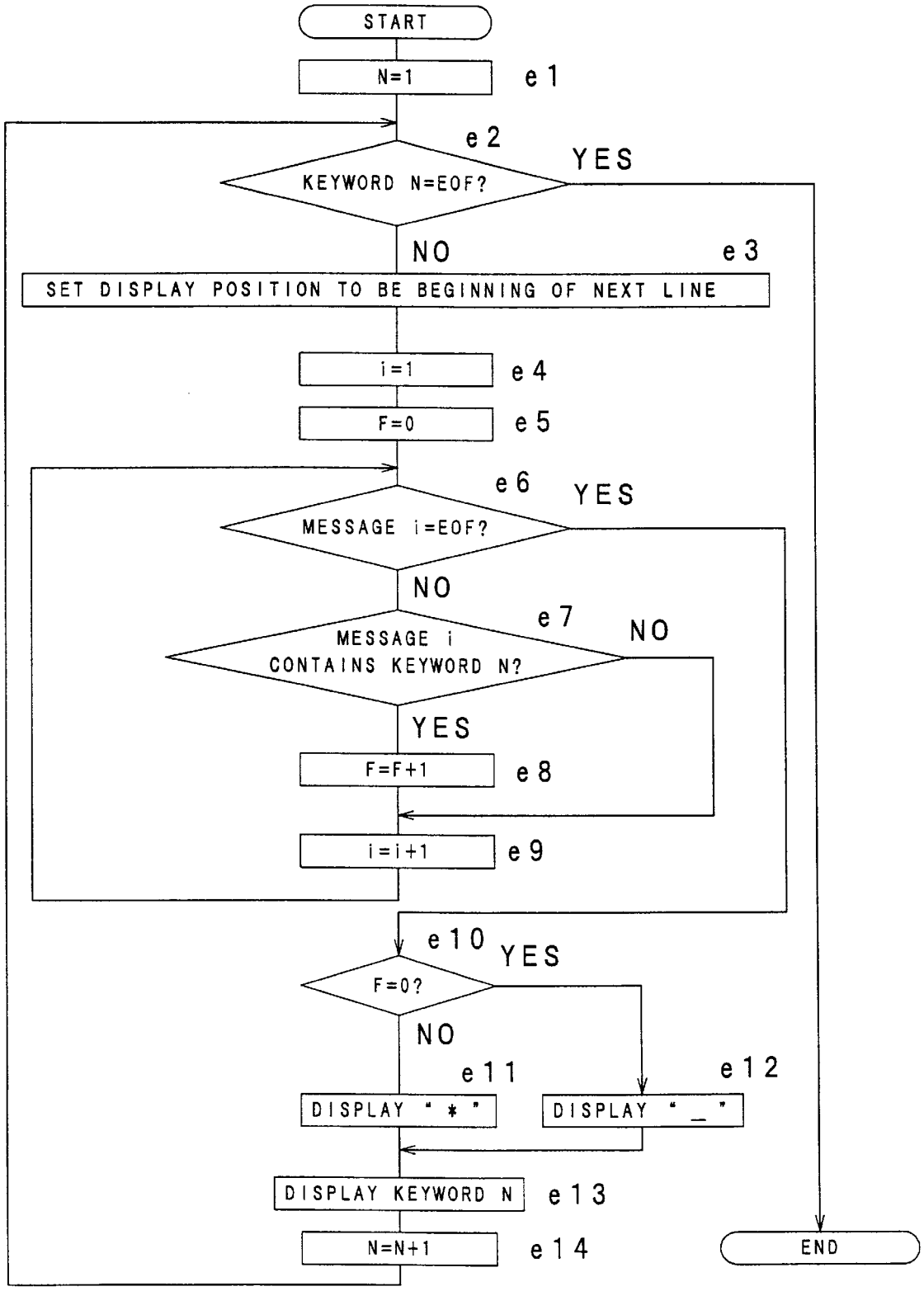
FIG. 21 is a flowchart showing an operation of displaying information indicating whether there is an unread received message or not.

FIG. 21 is a flowchart showing an operation of displaying information indicating whether there is an unread received message or not. In step e1, the parameter N is set to be 1. In step e2, It is judged whether the N-th keyword 42 is the end symbol 42*b* or not. If the keyword is the end symbol 42*b*, the operation is ended. If the keyword is not the end symbol 42*b*, the control advances to step e3.

In step e3, the display position is set to be the beginning of the next line. In step e4, the parameter i is set to be 1, and, In step e5, a parameter F is set to be 0.

In step e6, it is judged whether the i-th received message 46 is the end symbol 46*b* or not. If the message is the end symbol 46*b*, the control advances to step e10. If the message is not the end symbol 46*b*, the control advances to step e7.

In step e7, it is judged whether the i-th received message 46 contains the N-th keyword 42 or not. If the message contains the keyword, the control advances to step e8, and, if the message does not contain the keyword, the control advances to step e9.

In step e8, the parameter F is set to be F+1, and the control then advances to step e9. In step e9, the parameter i is set to be i+1, and the control then returns to step e6.

In step e10. It is judged whether the parameter F is 0 or not. If the parameter is 0, the control advances to step e12. If the parameter is not 0, the control advances to step e11. In step e11, the predetermined symbol 73 indicating that there is an unread received message is displayed, and the control then advances to step e13. In step e12, a predetermined symbol indicating that there is not an unread received message is displayed, and the control then advances to step e13. Alternatively, the state that there is not an unread received message may be indicated by displaying no symbol.

In step e13, the N-th keyword 42 is displayed. In step e14, the parameter N is set to be N+1, and the control then returns to step e2.

Figure 22:
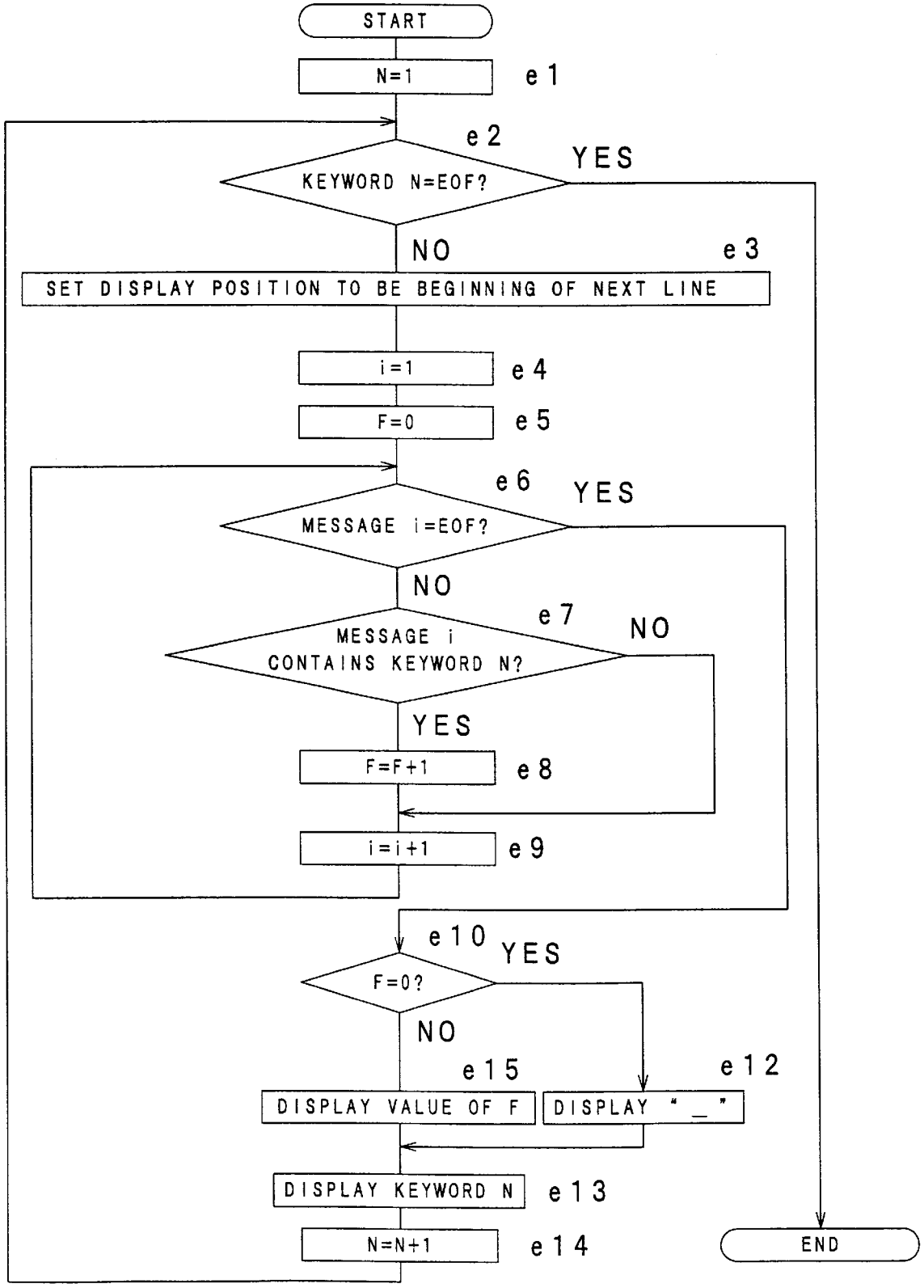
FIG. 22 is a flowchart showing an operation of displaying information indicative of the number of unread received messages.

FIG. 22 is a flowchart showing an operation of displaying information indicative of the number of unread received messages. The flowchart is configured by replacing step e11 of the flowchart of FIG. 21 with step e15. The description of the same steps is omitted.

In step e10, it is judged whether the parameter F is 0 or not. If the parameter is 0, the control advances to step e12. If the parameter is not 0, the control advances to step e15. Instep e15, the number of unread received messages, i.e., the value of the parameter F is displayed, and the control then advances to step e13.

As described above, according to the tenth embodiment, information indicating that there is an unread received message(s) 46 which has not been displayed on the displaying unit 30, or the number the unread received message(s) is displayed. Therefore, the user can know presence or absence of or the number of the unread message(s), together with the received message 46.

Next, a paging receiver of an eleventh embodiment of the invention will be described. The paging receiver of the eleventh embodiment is characterized in that a fact that there is an unread message(s) is notified by a vibration, or acoustic means. An example in which the embodiment is applied to the paging receiver 21 of the first embodiment will be described.

Figures 23, 24:
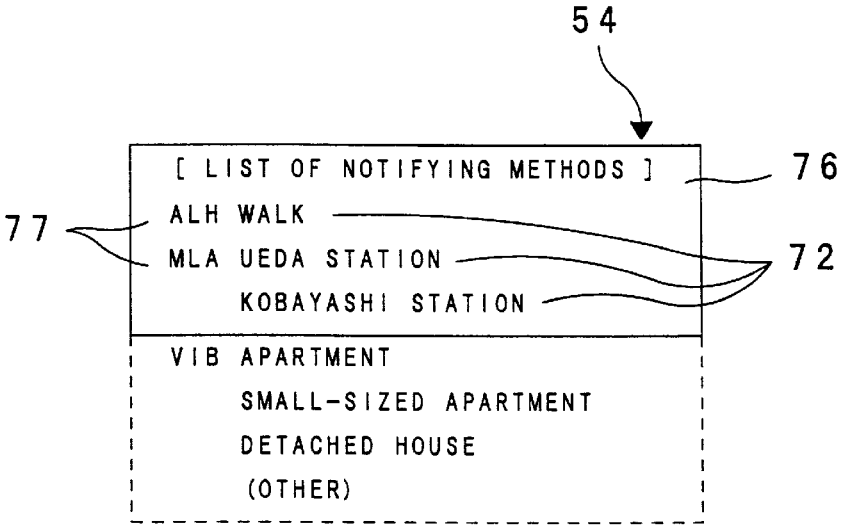
FIG. 23 is a view showing a display screen 76 which illustrates a method of notifying of reception of a message in the paging receiver 21 of an eleventh embodiment of the invention.
FIG. 24 is a view showing a notifying method setting table 81.

FIG. 23 is a view showing a display screen 76 which illustrates a method of notifying of reception of a message in the paging receiver 21 of the eleventh embodiment. In the eleventh embodiment, in the case where the registered keywords are displayed in the form of a list, notifying methods 77 which are performed when messages respectively corresponding to keywords 72 are received are displayed for the keywords 72.

FIG. 24 is a view showing a notifying method setting table 81. In the notifying method setting table 81, notifying method code numbers 82 are stored in correspondence with various notifying methods 83 and display character strings 84 indicating notifying methods. The table 81 is previously stored in the program memory 23. When a keyword is to be registered, the method of notifying of reception of a corresponding message can be set. In this way, the notifying method code numbers 43 of the above-mentioned keyword storage table 35*a* can be set. The notifying method code numbers 43 correspond to the notifying method code numbers 82.

In the embodiment, reception can be notified by either of high and low alarm sounds, first to third melody sounds, and vibration. Any of these method can be designated as the notifying method. Alternatively, designation may be performed so that no notification is done.

Figure 25:
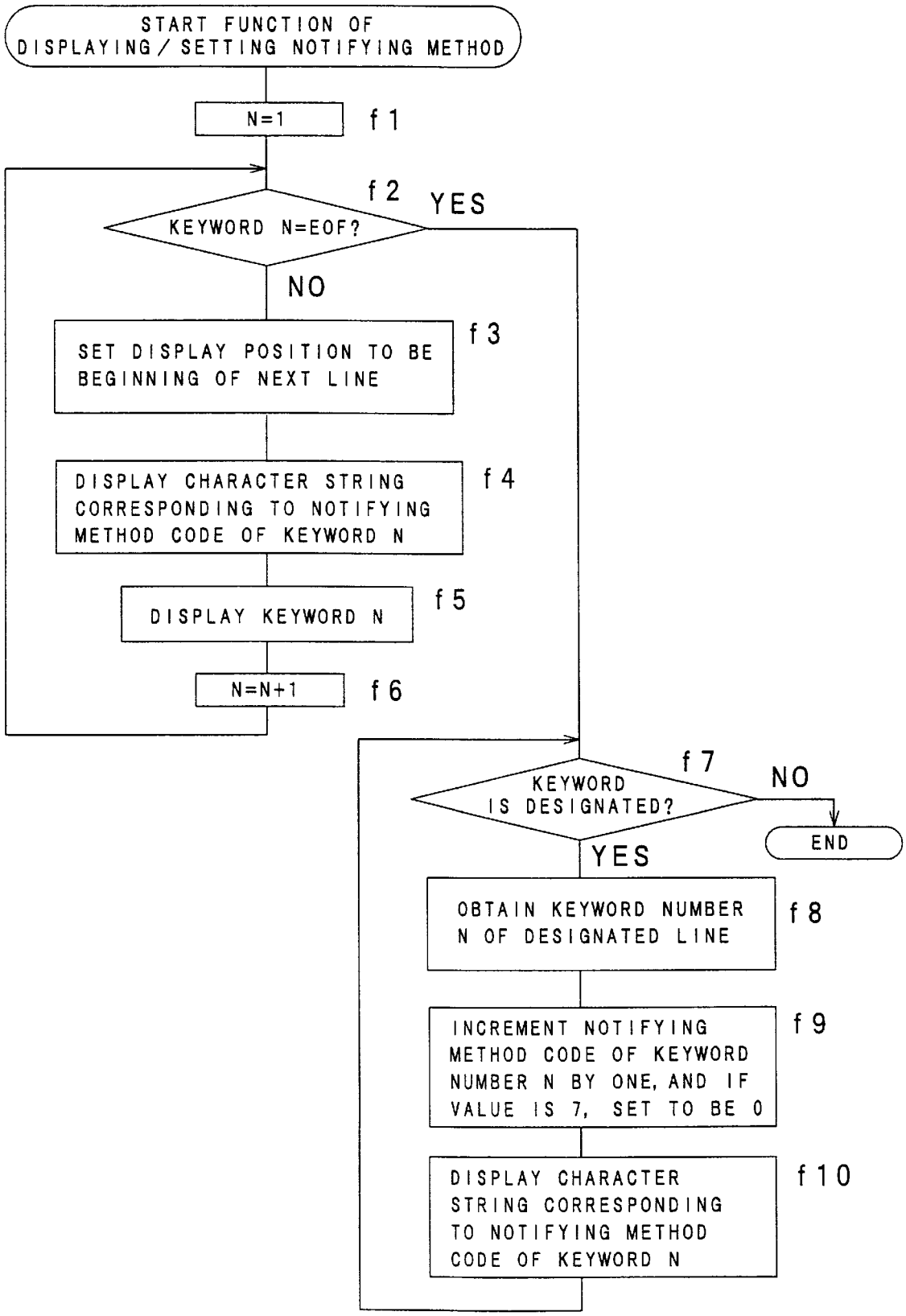
FIG. 25 is a flowchart showing operations of displaying a method of notifying of reception of a message and setting the notifying method.
Figure 26:
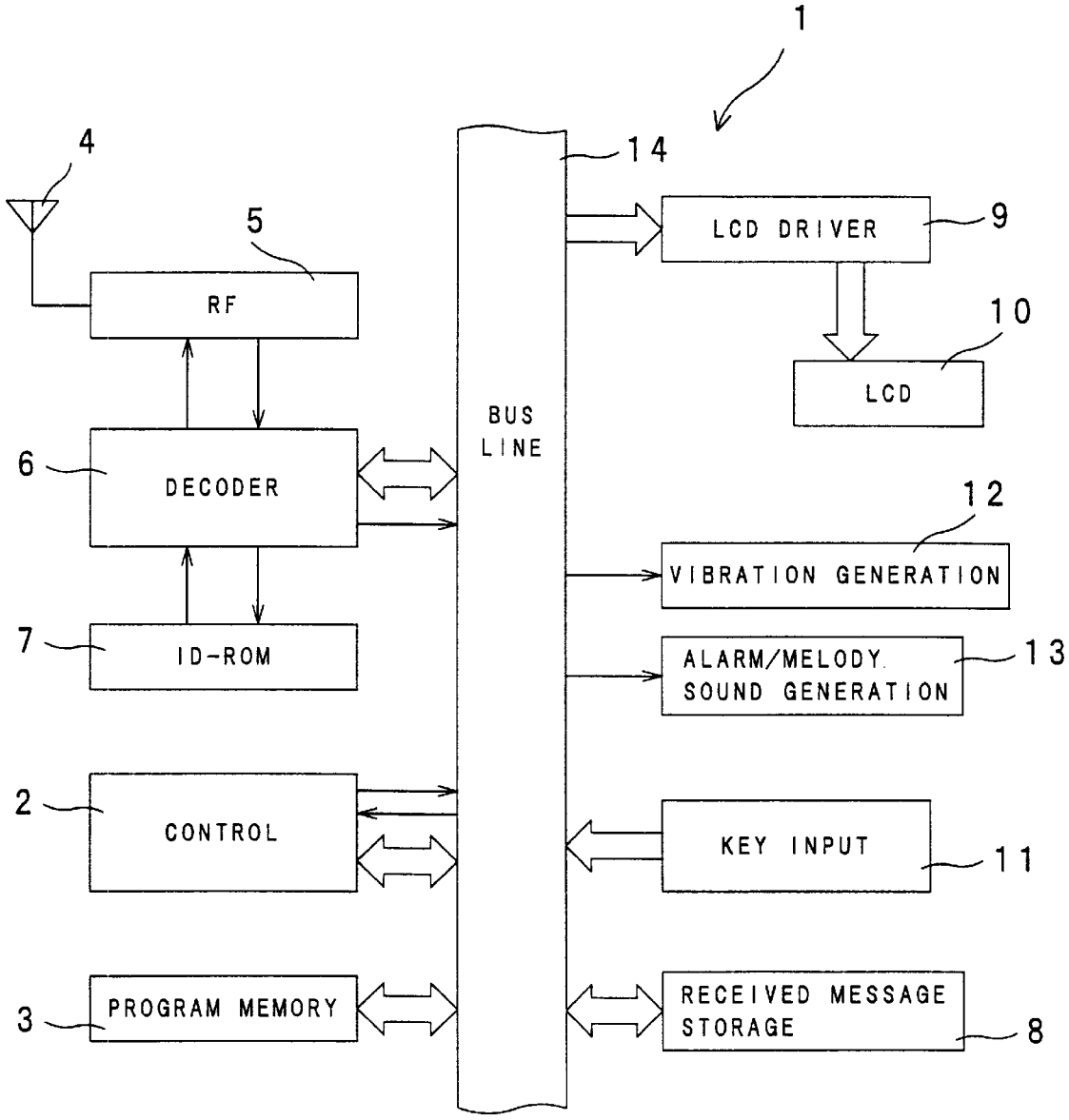
FIG. 26 PRIOR ART
FIG. 26 is a block diagram showing the electrical configuration of a paging receiver 1 of the prior art.
Figure 28A:
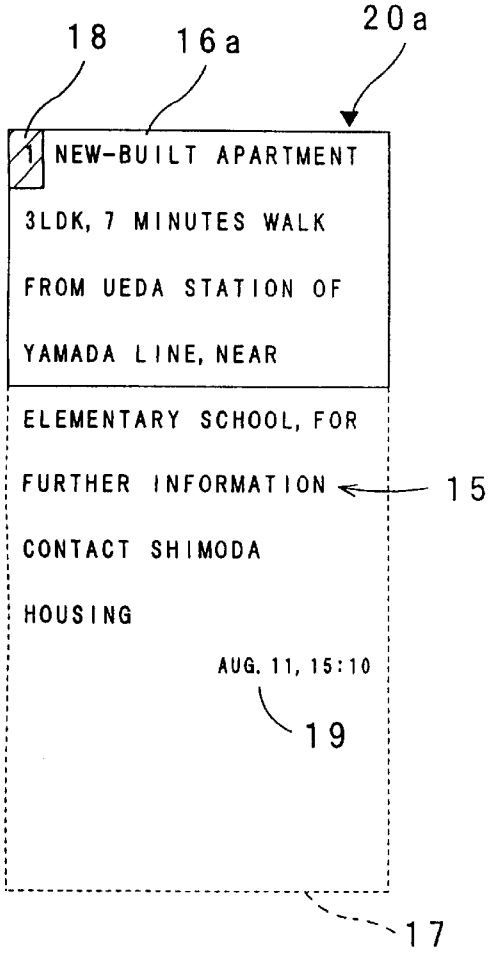
FIGS. 28A to 28C are views showing in stages display screens 16*a* to 16*c* in the case where the message 15 is displayed on an LCD 10.
Figure 28B:
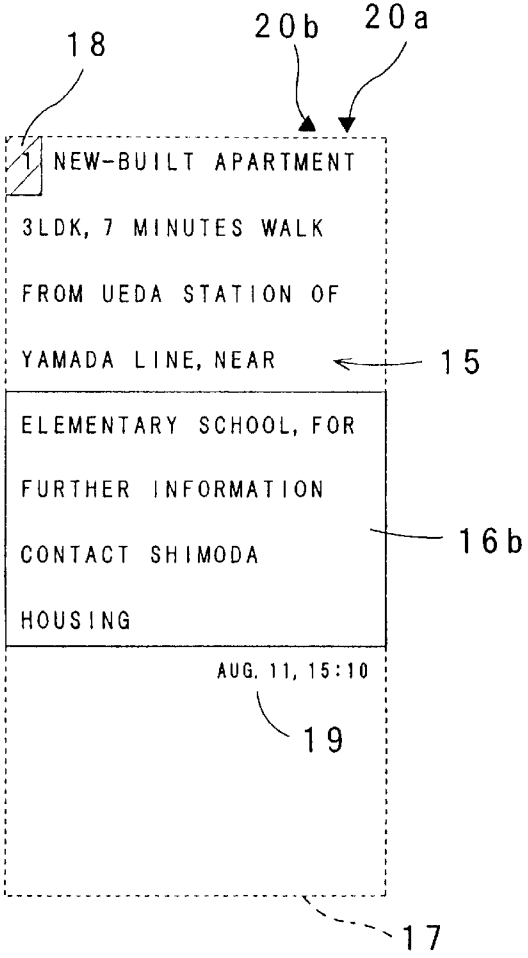
Figure 28C:
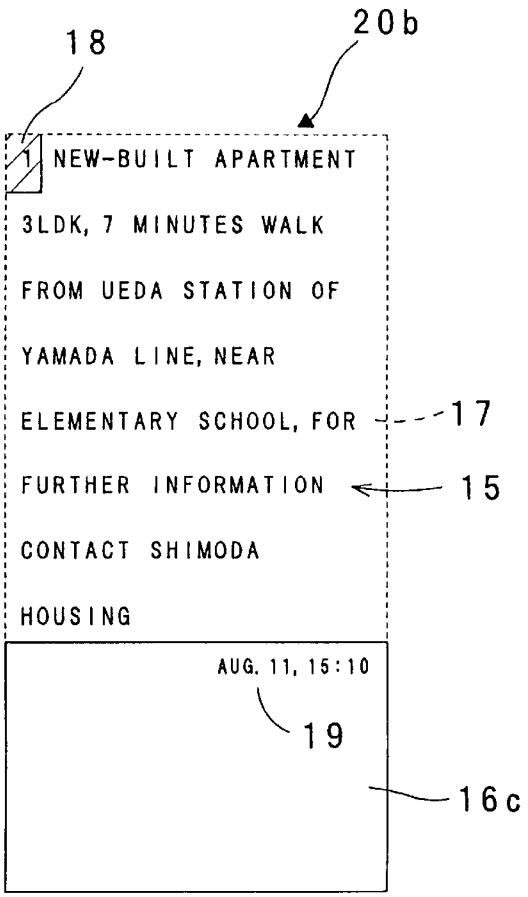

FIG. 25 is a flowchart showing operations of displaying a method of notifying an unread received message and setting the notifying method. In step f1, the parameter N is set to be 1. In step f2, it is judged whether the N-th keyword 42 is the end symbol 42*b* or not. If the keyword is the end symbol 42*b*, the control advances to step f7. If the keyword is not the end symbol 42*b*, the control advances to step f3.

In step f3, the display position is set to be the beginning of the next line. In step f4, the display character string 84 corresponding to the notifying method code number 82 of the N-th keyword 42 is displayed. In step f5, the N-th keyword 42 is displayed. In step f6, the parameter N is set to be N+1, and the control then returns to step f2.

In step f7, it is judged whether one of the keywords 72 is designated or not. If a keyword is designated, the control advances to step f8. If no keyword is designated, the operation is ended. In step f8, the number N of the designated keyword 72 is obtained. In step f9, the notifying method code number 82 of the N-th keyword 72 is incremented by one. If the value is equal to the maximum value of a keyword (in the embodiment, 7), the number is set to be 0. In step f10, the display character string 84 corresponding to the notifying method code number 82 of the N-th keyword is displayed, and the control then returns to step f7.

As described above, according to the eleventh embodiment, since the method of notifying of reception of a message is displayed, the user can know the notifying method which is to be performed when a corresponding message is received. Furthermore, the user can know that a corresponding message is received, by a sound, a vibration amplitude, or a vibration period which is differently set for each keyword.

The seventh to eleventh embodiments have been described as the examples in which the embodiments are applied to the first embodiment. Examples in which the embodiments are applied to any one of the second to sixth embodiments are also In the scope of the invention.

One paging receiver may be configured so as to selectively execute the functions of the first to sixth embodiments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A receiver which receives a message transmitted from a terminal device and stores the received message in a message storage, the receiver comprising:

keyword setting means for setting a predetermined keyword;

keyword storing means for storing the set keyword;

judging means for judging, when a message is received, whether the received message contains the keyword stored in the keyword storing means or not; and controlling means for storing only a received message which is judged by the judging means to contain the keyword, in the message storage;

wherein the keyword storing means stores a plurality of keywords which are ordered in accordance with importance, the judging means judges whether the received message contains the keywords stored in the keyword storing means or not, the controlling means stores only a received message which is judged by the judging means to contain at least one of the plurality of keywords, in the message storage, with the received message classified according to the keyword, and the message storage stores, with respect to a first keyword of highest importance, all messages containing the first keyword in an area corresponding to the first keyword, and stores, with respect to keywords of second and subsequent importance, for each corresponding keyword, a message which is a message other than messages containing keywords of higher importance and which contains the corresponding keyword, in area respectively corresponding to the keywords of second and subsequent importance.

2. The receiver of claim 1, wherein the keyword storing means stores a plurality of keywords, the judging means judges whether the received message contains the keywords stored in the keyword storing means or not, and the controlling means stores only a received message which is judged by the judging means to contain all of the plurality of keywords, in the message storage.

3. The receiver of claim 1, wherein the keyword storing means stores a plurality of keywords, the judging means judges whether the received message contains the keywords stored in the keyword storing means or not, and the controlling means stores only a received message which is judged by the judging means to contain at least one of the plurality of keywords, in the message storage.

4. The receiver of claim 1, further including notifying means that notifies that there is an unread message by a sound, a vibration amplitude or a vibration period which is differently set for each keyword.

5. A receiver which receives a message transmitted from a terminal device and stores the received message in a message storage, the receiver comprising:

keyword setting means for setting a predetermined keyword;

keyword storing means for storing the set keyword;

judging means for judging, which message is received, whether the received message contains the keyword stored in the keyword storing means or not; and controlling means for storing a received message which is judged by the judging means to contain the keyword, in the message storage as distinguished from other received messages;

wherein the keyword storing means stores a plurality of keywords which are ordered in accordance with importance, the judging means judges whether the received message contains the keywords stored in the keyword storing means or not, the controlling means classifies a received message which is judged by the judging means to contain at least one of the plurality of keywords, for each corresponding keyword, as distinguished from other received messages, and stores the classified received messages in the message storage, and the message storage stores, with respect to a first keyword of highest importance, all messages containing the first keyword in an area corresponding to the first keyword, and stores, with respect to keywords of second and subsequent importance, for each corresponding keyword, a message which is one other than messages containing keywords of higher importance and which contains the corresponding keyword, in area respectively corresponding to the keywords of second and subsequent importance.

6. The receiver of claim 5, wherein the keyword storing means stores a plurality of keywords, the judging means judges whether thee received message contains the keywords stored in the keyword storing means or not, and the controlling means stores a received message which is judged by the judging means to contain all of the plurality of keywords, in the message storage as distinguished from other received messages.

7. The receiver of claim 5, wherein the keyword storing means stores a plurality of keywords, the judging means judges whether the received message contains the keywords stored in the keyword storing means or not, and the controlling means stores a received message which is judged by the judging means to contain at least one of the plurality of keywords, in the message storage as distinguished from other received messages.

8. A receiver which receives a message transmitted from a terminal device and stores the received message in a message storage, the receiver comprising:

keyword setting means for setting a predetermined keyword;

keyword storing means for storing the set keyword;

judging means for judging when a message is received, whether the received message contains the keyword stored in the keyword storing means or not; and controlling means for storing only a received message which is judged by the judging means to contain the keyword, in the message storage;

wherein the keyword storing means stores a plurality of keywords, the judging means judges whether the received message contains the keywords stored in the keyword storing means or not, the controlling means classifies only received messages which are judged by the judging means to contain at least one of the plurality of keywords, for each corresponding keyword, and stores the classified received messages in the message storage, and the message storage stores all messages containing a keyword, in an area respectively corresponding to the corresponding keyword.

9. A receiver which receives a message transmitted from a terminal device and stores the received message in a message storage, the receiver comprising:

keyword setting means for setting a predetermined keyword;

keyword storing means for storing the set keyword;

judging means for judging, which message is received, whether the received message contains the keyword stored in the keyword storing means or not; and controlling means for storing a received message which is judged by the judging means to contain the keyword, in the message storage as distinguished from other received messages; wherein the keyword storing means stores a plurality of keywords, the judging means judges whether the received message contains the keywords stored in the keyword storing means or not, the controlling means classifies only received messages which are judged by the judging means to contain at least one of the plurality of keywords, for each corresponding keyword, and stores the classified received messages in the message storage, and the message storage stores all messages containing any keyword, in an area corresponding to the contained keyword.

* * * * *